US010422547B2

(12) United States Patent
Hamada et al.

(10) Patent No.: US 10,422,547 B2
(45) Date of Patent: Sep. 24, 2019

(54) AIR-CONDITIONING APPARATUS

(71) Applicant: Mitsubishi Electric Corporation, Tokyo (JP)

(72) Inventors: Mamoru Hamada, Tokyo (JP); Fumitake Unezaki, Tokyo (JP); Hitoshi Kikuchi, Tokyo (JP); Shigeki Onishi, Tokyo (JP); Naoto Ariyoshi, Tokyo (JP); Naomichi Tamura, Tokyo (JP); Kazunobu Nishimiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 586 days.

(21) Appl. No.: 14/398,987

(22) PCT Filed: May 14, 2013

(86) PCT No.: PCT/JP2013/063376
§ 371 (c)(1),
(2) Date: Nov. 5, 2014

(87) PCT Pub. No.: WO2013/172327
PCT Pub. Date: Nov. 21, 2013

(65) Prior Publication Data

US 2015/0300675 A1 Oct. 22, 2015

(30) Foreign Application Priority Data

May 16, 2012 (JP) ..... 2012-112813

(51) Int. Cl.
*F24F 11/89* (2018.01)
*F24F 3/06* (2006.01)
*F24F 140/50* (2018.01)

(52) U.S. Cl.
CPC ..... *F24F 11/89* (2018.01); *F24F 3/065* (2013.01); *F24F 2140/50* (2018.01)

(58) Field of Classification Search
CPC ..... F24F 11/02; F24F 3/065; F24F 2011/0046
See application file for complete search history.

(56) References Cited

U.S. PATENT DOCUMENTS 4,711,394 A * 12/1987 Samuel ..... F24F 3/0442 165/209
5,317,907 A * 6/1994 Shimizu ..... F24F 3/065 62/176.6

(Continued)

FOREIGN PATENT DOCUMENTS

EP 1902284 A1 * 3/2008
JP 2003-065588 A 3/2003

(Continued)

OTHER PUBLICATIONS

Fukumura, Air Conditioning System and its Operation Method, Nov. 9, 2006, JP2006308212A, Whole Document.*

(Continued)

*Primary Examiner* — Larry L Furdge
(74) *Attorney, Agent, or Firm* — Posz Law Group, PLC

(57) ABSTRACT

An air-conditioning apparatus includes refrigerant systems that each include an outdoor unit and indoor units and that air-condition a single room, and circulators for making a temperature distribution in the room uniform. The air-conditioning apparatus determines a load on each of the two refrigerant systems in operation, and, if it is determined that improvement of operating efficiency is possible on the basis of the determination result, performs a system-selective operation in which operation of one of the refrigerant systems determined to be under a low load is stopped and the other refrigerant system determined to be under a high load is selectively performed, and causes the circulators to transport blown air blown from the indoor units of the refrigerant system determined to be under a high load to an air- (Continued)

conditioned zone of the refrigerant system determined to be under a low load.

18 Claims, 13 Drawing Sheets

(56) References Cited

U.S. PATENT DOCUMENTS

| | | | | |
|---|---|---|---|---|
| 2010/0174414 | A1 | 7/2010 | Takagi et al. | |
| 2011/0058968 | A1* | 3/2011 | Kang | F04B 17/04 417/415 |

FOREIGN PATENT DOCUMENTS

| | | | | |
|---|---|---|---|---|
| JP | 2003065588 | A | * | 3/2003 |
| JP | 2006-308212 | A | | 11/2006 |
| JP | 2006308212 | A | * | 11/2006 |
| JP | 2007-010204 | A | | 1/2007 |
| JP | 2007010204 | A | * | 1/2007 |
| JP | 2007-271112 | A | | 10/2007 |
| JP | 2008157563 | A | * | 7/2008 |
| JP | 2009-210237 | A | | 9/2009 |
| JP | 2009-236398 | A | | 10/2009 |
| JP | 2009-257617 | A | | 11/2009 |
| JP | 2010-014364 | A | | 1/2010 |
| JP | 2010014364 | | * | 1/2010 |
| JP | 2010-159905 | A | | 7/2010 |
| JP | 2010159905 | A | * | 7/2010 |
| JP | 2010-257611 | A | | 11/2010 |
| JP | 2011-052851 | A | | 3/2011 |
| JP | 2012-007833 | A | | 1/2012 |
| JP | 2012-013389 | A | | 1/2012 |

OTHER PUBLICATIONS

Watanabe et al., Air Conditioning Apparatus, Mar. 5, 2003, JP2003065588A, Whole Document.*

Yoshida et al., Air Conditioning Apparatus and Control Method Therefor, Jul. 10, 2008, JP2008157563A, Whole Document.*

Takagi et al., Air Conditioning System, Jul. 22, 2010, JP2010159905A, Whole Document.*

Matsuzawa et al., Energy Management Device for Facility, Jan. 18, 2007, JP2007010204A, Whole Document.*

Hoyer, Apparatus and Method for Determining the Energy Input into a Room by a Radiation Source, Mar. 26, 2008, EP1902284A1, Whole Document.*

Hiroyuki et al., Air Conditioning System and Method of Controlling the Same, Jan. 2010, JP2010014364A, Whole Document.*

International Search Report of the International Searching Authority dated Jul. 30, 2013 for the corresponding international application No. PCT/JP2013/063376 (and English translation).

Office Action dated Jul. 2, 2013 issued in corresponding JP patent application No. 2012-112813 (and English translation).

Office Action dated Jul. 5, 2016 issued in corresponding CN patent application No. 201380025184.0 (and English translation).

Office Action dated Dec. 13, 2016 issued in corresponding CN patent application No. 201380025184.0 (and English translation).

Office Action dated Aug. 23, 2018 issued in corresponding GB patent application No. 1419451.8.

* cited by examiner

AIR-CONDITIONING APPARATUS

CROSS REFERENCE TO RELATED APPLICATIONS

This application is a U.S. national stage application of PCT/JP2013/063376 filed on May 14, 2013, and is based on Japanese Patent Application No. 2012-112813 filed on May 16, 2012, the contents of which are incorporated herein by reference.

TECHNICAL FIELD

The present invention relates to an air-conditioning apparatus.

BACKGROUND

To date, air-conditioning apparatuses have been proposed that include a plurality of indoor units that are disposed in an air conditioned region and that are grouped into a plurality of systems; a plurality of outdoor units each of which is provided in a corresponding one of the systems and that operate in accordance with requests from the indoor units of the system; system control means that controls corresponding outdoor units in accordance with requests from the indoor units of the systems; and integrated control means that stops some of the systems in accordance with operating loads on the systems (see, for example, Patent Literature 1).

The air-conditioning apparatus can improve air-conditioning efficiency because the air-conditioning load per system can be increased by stopping systems that are operating under a low load. Accordingly, the efficiency of a cooling operation or a heating operation in an intermediate period, which is performed under a low air conditioning load, can also be improved.

In the air-conditioning apparatus, in order to reduce nonuniformity in an air-conditioning effect (temperature distribution in a room), each of the indoor units of one system is disposed so as to be adjacent to a corresponding one of the indoor units of another system (the same applies to Patent Literature 2).

In order to improve comfort in a room, air-conditioning systems have been proposed that control air conditioning by dividing the room into zones by estimating the temperature distribution in the room and controlling a stationary air conditioner and a circulator on the basis of the estimated temperature distribution (see, for example, Patent Literature 3).

Patent Literature

Patent Literature 1: Japanese Unexamined Patent Application Publication No. 2003-65588 (page 3, FIG. 2)

Patent Literature 2: Japanese Unexamined Patent Application Publication No. 2006-308212 (Abstract, FIG. 1)

Patent Literature 3: Japanese Unexamined Patent Application Publication No. 2009-257617 (Abstract, FIG. 2)

The air-conditioning apparatuses described in Patent Literatures 1 and 2 have problems in that, because the arrangement of the indoor units is complex, the efficiency with which pipes are installed and the maintenance is performed is low, the installation time takes long, and the installation cost is high. Moreover, with a method in which the air-conditioned zone of stopped indoor units is air-conditioned by using adjacent indoor units, the heat transport capability is insufficient and therefore it is difficult to eliminate nonuniformity in an air-conditioning effect.

The air-conditioning system described in Patent Literature 3, which can improve comfort in a room by using a circulator, does not increase operating efficiency of the air-conditioning apparatus.

SUMMARY

An object of the present invention, which has been made under the circumstances described above, is to provide an air-conditioning apparatus that can provide comfort and reduce power consumption by improving the heat transport capability while reducing the installation period and the installation cost.

According to the present invention, an air-conditioning apparatus includes two refrigerant systems each including an outdoor unit and one or more indoor units and configured to air-condition a single room; one or more circulators configured to make a temperature distribution in the room uniform; a load determination device configured to determine a load on each of the two refrigerant systems in operation; and a controller configured to control operations of the refrigerant systems and the circulators. If the controller determines that improvement of operating efficiency is expected on a basis of a determination result obtained by the load determination device, the controller performs a system-selective operation in which one of the refrigerant systems determined to be under a low load is stopped and the other refrigerant system determined to be under a high load is selectively performed, operates one of the circulators that is disposed at a position at which the circulator is capable of drawing blown air blown from a corresponding one of the indoor units of the refrigerant system determined to be under the high load, and causes the circulator to draw the blown air and to blow the air toward an air-conditioned zone of the refrigerant system determined to be under the low load.

According to the present invention, when the air-conditioning apparatus is operating under a low load, the compressor operation efficiency can be increased by selectively operating one of the refrigerant systems under a high load, and therefore power consumption can be reduced. Moreover, because blown air blown from indoor units of the refrigerant system under a high load is transported to an air-conditioned zone of the other refrigerant system under a low load, heat transport capability can be increased. Installation of circulators can be performed in a period shorter than and at a cost lower than rearrangement of outdoor units and indoor units. Consequently, while maintaining comfort, the power consumption can be reduced in a shorter installation period and at a lower cost.

DETAILED DESCRIPTION

Embodiment 1

Figure 1:
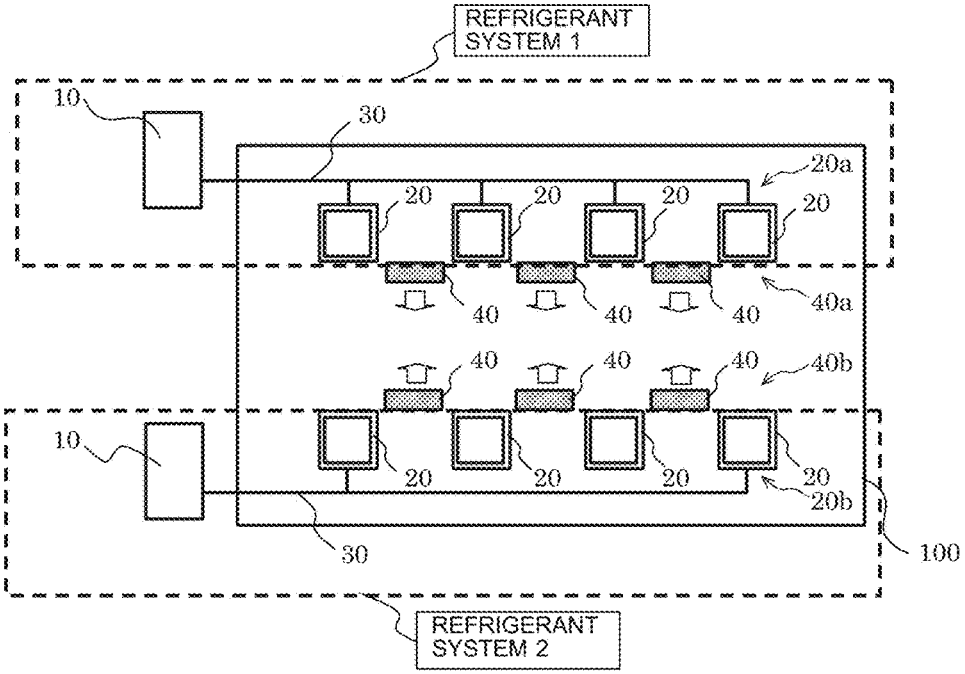
FIG. 1 is a floor plan view of a building in which an air-conditioning apparatus according to Embodiment 1 of the present invention is installed.
Figure 2:
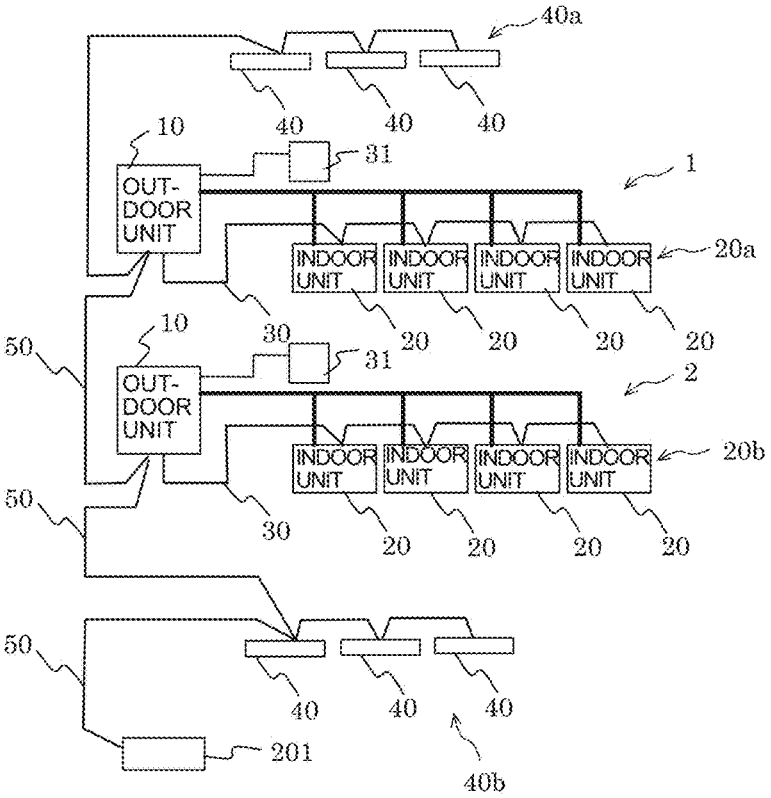
FIG. 2 illustrates a connection configuration of the air-conditioning apparatus according to Embodiment 1 of the present invention.

FIG. 1 is a floor plan view of a building in which an air-conditioning apparatus according to Embodiment 1 of the present invention is installed. FIG. 2 illustrates a connection configuration of the air-conditioning apparatus according to Embodiment 1 of the present invention. In FIGS. 1, 2, and other figures described later, elements denoted by the same numerals are identical or equivalent to each other. The same applies to the entirety of the description. The configurations of elements described in the entirety of the description are only examples and are not limited to those that are described herein.

As illustrated in FIG. 1, the air-conditioning apparatus includes a plurality of (here, two) air-conditioning systems, which are a refrigerant systems 1 and a refrigerant system 2. Each of the refrigerant systems 1 and 2 includes an outdoor unit 10 and indoor units 20, which are connected to the outdoor unit 10 through a refrigerant pipe 30. Here, each of the refrigerant systems 1 includes four indoor units 20. However, the number of the indoor units 20 may be any appropriate number. Hereinafter, for the sake of identification, the indoor units 20 of the refrigerant system 1 may be referred to as indoor units 20*a* and the indoor units 20 of the refrigerant system 2 may be referred to as indoor units 20*b*.

In the respective refrigerant systems 1 and 2, the indoor units 20*a* and 20*b* are linearly arranged on the ceiling of a room 100 with distances therebetween. An air-conditioned zone of the refrigerant system 1 and an air-conditioned zone of the refrigerant system 2 are formed in the room 100. The indoor units 20*a* and 20*b* draw indoor air thereinto from the vicinity of the ceiling, cool or heat the drawn indoor air, and then blow the indoor air into the room 100, thereby air-conditioning the single room 100.

The air-conditioning apparatus further includes circulators 40, which are provided for each of the refrigerant systems 1 and 2. Here, three circulators 40 are provided for each of the refrigerant systems 1 and 2. However, the number of the circulators 40 may be any appropriate number. Also regarding the circulators 40, for the sake of identification, the circulators 40 for the refrigerant system 1 may be referred to as circulators 40*a* and circulators 40 for the refrigerant system 2 may be referred to as circulators 40*b*.

The circulators 40 are disposed on the ceiling of the room 100 in the vicinity of the indoor units 20 of one of the refrigerant systems for which the circulators 40 are provided. The circulators 40 draw blown air blown from the indoor units 20 of the one of the refrigerant systems and blow the air toward the air-conditioned zone of the other refrigerant system to transport the air. The circulators 40 may be disposed at any positions as long as the circulators 40 can draw blown air blown from the indoor units of the one of the refrigerant systems and can blow the air toward the air-conditioned zone of the other refrigerant system.

The air-conditioning apparatus further includes an integrated controller 201, which is a controller for controlling the entire apparatus. The refrigerant systems 1 and 2, the circulators 40, and the integrated controller 201 are connected to each other through transmission lines 50. Each of the refrigerant systems 1 and 2 includes a load detection device 31 that detects an air conditioning load on a corresponding one of the refrigerant systems 1 and 2.

Figure 3:
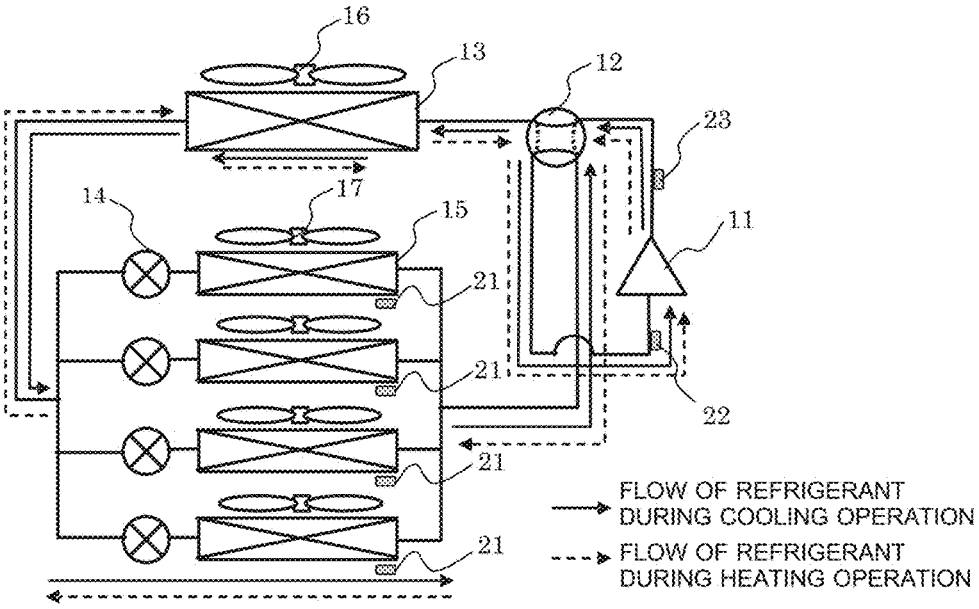
FIG. 3 illustrates a refrigerant circuit of the air-conditioning apparatus according to Embodiment 1 of the present invention.

FIG. 3 illustrates a refrigerant circuit of the air-conditioning apparatus according to Embodiment 1 of the present invention. FIG. 3 illustrates a refrigerant circuit of one of the refrigerant systems.

The refrigerant circuit includes a compressor 11, a four-way valve 12, an outdoor heat exchanger 13, expansion valves 14, and indoor heat exchangers 15, which are connected to each other through pipes so that a refrigerant can circulate. The air-conditioning apparatus further includes an outdoor heat exchanger fan 16, which blows outdoor air toward the outdoor heat exchanger 13, and indoor heat exchanger fans 17, which blow indoor air toward the indoor heat exchangers 15. Note that it is only necessary for the air-conditioning apparatus to be capable of performing one of a cooling operation and a heating operation. Therefore, the four-way valve 12 may not be necessary and may be omitted.

The refrigerant circuit in a cooling operation will be described. Flow of the refrigerant during a cooling operation is indicated by solid lines in FIG. 3. High-temperature and high-pressure gas refrigerant discharged from the compressor 11 flows through the four-way valve 12 to the outdoor heat exchanger 13, in which the refrigerant is condensed and liquefied by exchanging heat with air. After being condensed and liquefied, the pressure of the refrigerant is reduced by the expansion valve 14 so that the refrigerant becomes a low-pressure two-phase gas-liquid refrigerant, and the refrigerant flows to the indoor heat exchangers 15, in which the refrigerant is gasified by exchanging heat with air. The gasified refrigerant flows through the four-way valve 12 and is sucked into the compressor 11. At this time, the outdoor heat exchanger fan 16 and the indoor heat exchanger fans 17 blow air toward corresponding heat exchangers. The air blown by the indoor heat exchanger fans 17 is cooled, blown into the room 100, and cools the room 100.

Next, a heating operation will be described. Flow of the refrigerant during a heating operation is indicated by dotted lines in FIG. 3. High-temperature and high-pressure gas refrigerant discharged from the compressor 11 flows through the four-way valve 12 to the indoor heat exchangers 15, in which the refrigerant is condensed and liquefied by exchanging heat with air. After being condensed and liquefied, the pressure of the refrigerant is reduced by the expansion valve 14 so that the refrigerant becomes a low-pressure two-phase gas-liquid refrigerant, and the refrigerant flows to the outdoor heat exchanger 13, in which the refrigerant is gasified by exchanging heat with air. The gasified refrigerant flows through the four-way valve 12 and sucked into the compressor 11. At this time, the outdoor heat exchanger fan 16 and the indoor heat exchanger fans 17 blow air toward corresponding heat exchangers. The air blown by the indoor heat exchanger fans 17 is heated, blown into the room 100, and heats the room 100.

(Capacity Adjustment of Refrigerant Circuit (Thermo ON, Thermo OFF))

Next, operations of capacity adjustment performed during a cooling operation and a heating operation will be described. As illustrated in FIG. 3, each of the indoor units 20 is provided with an inlet-air-temperature detection device 21 that is disposed near an air inlet of a corresponding one of the indoor heat exchangers 15. T denotes a detection value of the inlet-air-temperature detection device 21, and T0 denotes a set temperature. The temperature difference ΔT (degrees C.) during a cooling operation is defined by expression (1). The temperature difference ΔT (degrees C.) during a heating operation is defined by expression (2).

$$\text{during cooling operation } \Delta T = T - T0 \quad (1)$$

$$\text{during heating operation } \Delta T = T0 - T \quad (2)$$

Figure 4:
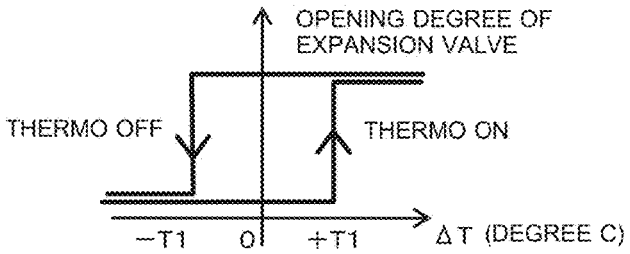
FIG. 4 illustrates thermo ON/OFF control of the air-conditioning apparatus of FIG. 1.

As illustrated in FIG. 4, each of the indoor units opens the expansion valve 14 to allow the refrigerant to flow to the indoor heat exchanger 15 when the temperature difference ΔT (degrees C.) between the detection value T (degrees C.) of the inlet-air-temperature detection device 21 and the set temperature T0 (degrees C.) becomes larger than +T1 (degrees C.). Hereinafter, this mode will be referred to as "thermo ON". Each of the indoor units 20 closes the expansion valve 14 to stop or reduce the flow of the refrigerant when the temperature difference ΔT (degrees C.) becomes smaller than or equal to −T1 (degrees C.). Hereinafter, this mode will be referred to as "thermo OFF".

The outdoor unit 10 operates the compressor 11 when at least one of the indoor units 20 connected to the outdoor unit 10 enters the thermo ON mode. When all of the indoor units 20 connected to the outdoor unit 10 enter the thermo OFF mode, the outdoor unit 10 sets the compressor frequency at 0 Hz and stops the compressor 11.

In a cooling operation, the outdoor unit 10 controls the frequency of the compressor 11 so that the detection value of an evaporating temperature detection device 22, which is illustrated in FIG. 3, becomes the same as a target evaporating temperature ET. In terms of the relationship between the detection value of the inlet-air-temperature detection device 21 and the set temperature, this frequency control is performed so that the compressor frequency is reduced if the detection value of the inlet-air-temperature detection device 21 is lower than the set temperature and the compressor frequency is increased if the detection value is higher than or equal to the set temperature.

In a heating operation, the outdoor unit 10 controls the frequency of the compressor 11 so that the detection value of a condensing temperature detection device 23, which is illustrated in FIG. 3, becomes the same as a target condensing temperature CT. In terms of the relationship between the detection value of the inlet-air-temperature detection device 21 and the set temperature, this frequency control is performed so that the compressor frequency is reduced if the detection value of the inlet-air-temperature detection device 21 is higher than the set temperature and the compressor frequency is increased if the detection value lower than or equal to the set temperature.

When the number of indoor units in the thermo ON mode increases, the number of the indoor heat exchangers 15 through which the refrigerant flows increases, so that the refrigerant more easily evaporates and the detection value of the evaporating temperature detection device 22 rises. Therefore, control is performed so as to make the detection value become the same as the target evaporating temperature ET by increasing the frequency of the compressor 11. Thus, the flow rate of the refrigerant increases and the amount of the heat exchanged by the entirety of the air-conditioning apparatus (hereinafter, refereed to as the capacity) increases.

As described above, the air-conditioning apparatus automatically switches the mode of each of the indoor units 20 in operation between the thermo ON mode and the thermo OFF mode in accordance with the temperature difference ΔT, thereby controlling the temperature of the room 100 to be maintained at a set temperature.

(Operating Efficiency Improvement 1)

Immediately after the compressor 11 is started, a sufficient amount of refrigerant is not delivered to the indoor heat exchangers 15 and the outdoor heat exchanger 13, and therefore operating efficiency is low. Therefore, in order to reduce power consumption, it is preferable that frequent starting and stopping of the compressor 11 in a short period of time be avoided and the compressor 11 be operated at a stable frequency.

(Operating Efficiency Improvement 2)

Figure 5:
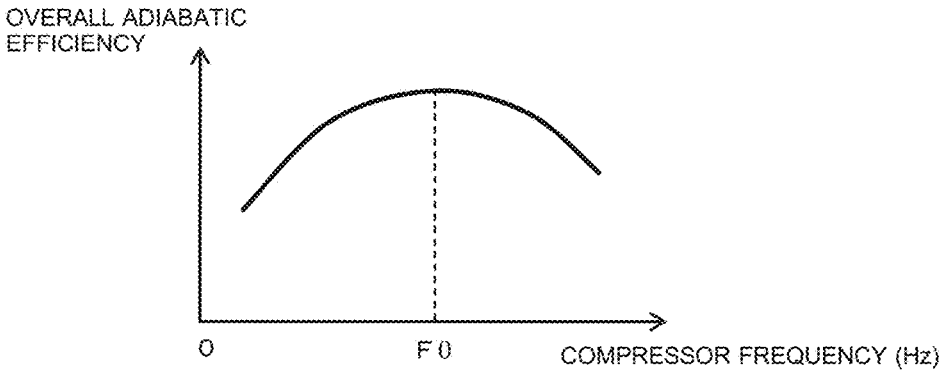
FIG. 5 illustrates the relationship between the frequency and the overall adiabatic efficiency of a general compressor.

FIG. 5 illustrates the relationship between the frequency and the overall adiabatic efficiency of a general compressor.

The term "theoretical adiabatic compression power" refers to the power of the compressor 11 when performing adiabatic compression. Actual compressor power is larger than the theoretical adiabatic compression power. The term "overall adiabatic efficiency" refers to the ratio of theoretical adiabatic compression efficiency to actual compressor power. Overall adiabatic efficiency is defined by expression (3). Adiabatic efficiency ηc and mechanical efficiency ηm are respectively represented by expressions (4) and (5).

$$\text{Overall Adiabatic Efficiency} = \eta c \times \eta m \quad (3)$$

$$\text{Adiabatic Efficiency } \eta c = \text{Theoretical Adiabatic Compression Power}/(\text{Actual Compressor Power} - \text{Mechanical Friction Loss}) \quad (4)$$

$$\text{Mechanical Efficiency } \eta m = (\text{Actual Compressor Power} - \text{Mechanical Friction Loss})/\text{Actual Compressor Power} \quad (5)$$

As illustrated in FIG. 5, the overall adiabatic efficiency has a characteristic that it changes in accordance with the frequency of the compressor 11. The overall adiabatic efficiency has the maximum efficiency value at F0 (Hz). When the frequency increases or decreases from F0, the overall adiabatic efficiency decreases, and the ratio of the amount of electric power consumed by the compressor 11 to the amount of heat exchanged by the entirety of the air-conditioning apparatus increases. It is preferable that the compressor 11 be operated in a frequency band around F0 in order that the compressor 11 can efficiently operate with low power consumption. The term "COP" refers to the ratio of the performance of the compressor 11 to the power consumption of the compressor 11. The higher the COP, the more efficient the operation is.

Air-conditioning apparatuses are operated in consideration of operating efficiency improvement 1 and operating efficiency improvement 2 described above.

Typically, the designing and selection of air-conditioning apparatuses are conducted in consideration of a mode in which the air conditioning load is maximum. However, in actual operations, the maximum load rarely occurs. Therefore, most of air-conditioning apparatuses are operated in a low load mode, in which the compressor frequency is low and the efficiently is low. Therefore, if the current operation is a low-efficiency operation, it is important to perform control so as to improve the efficiency. Embodiment 1 is aimed at performing a high-efficiency operation while providing comfort and realizes such an operation by performing a system-selective operation described below.

(Integrated Controller 201)

The integrated controller 201 includes a microcomputer, a CPU, a memory, and the like. The memory stores a control program, a program corresponding to a flowchart described below, and the like. For respective refrigerant systems 1 and 2, the integrated controller 201 stores the association between the indoor units 20*a* and 20*b* of the refrigerant systems 1 and 2 and the circulators 40*a* and 40*b*, which are disposed in the vicinity of the indoor units 20*a* and 20*b*. The integrated controller 201 further includes a load determination unit that determines which of the refrigerant systems 1 and 2 is under a high load or a low load on the basis of detection results sent from the load detection devices 31. The load determination unit and the load detection devices 31 constitute a load determination device.

The integrated controller 201 controls the operation of the air-conditioning apparatus by switching between a normal operation in which all of the refrigerant systems are operated and a system-selective operation in which some of the refrigerant systems are selectively operated. The normal operation and the system-selective operation are the same in that control is performed so as to switch the modes of the indoor units in operation between the thermo ON mode and the thermo OFF mode. The system-selective operation is performed when the load of the room 100 is low and if it is determined that improvement of operating efficiency is possible by performing the system-selective operation than by performing the normal operation. When the load of the room 100 is large, the normal operation is performed so as to handle the load and improve comfort in the room 100.

Overview of Control according to Embodiment 1

Hereinafter, an overview of control according to Embodiment 1 will be described.

In the normal operation, the indoor units 20 are automatically switched between the thermo ON and thermo OFF in accordance with the temperature difference ΔT as described above, so that the temperature of the room 100 is maintained at a set temperature. If the load of the room 100 (temperature load) were small, the compressor frequencies of both of the refrigerant systems 1 and 2 would be low, and if the compressor frequencies became significantly lower than the frequency F0, at which the overall adiabatic efficiency is high, operating efficiency might become low.

In such a case, it is probable that the total power consumption of the entirety of the air-conditioning apparatus can be reduced by selectively operating one of the refrigerant systems 1 and 2 that is under a high load than by operating both of the refrigerant systems 1 and 2. To be specific, as a result of selectively operating one of the refrigerant systems 1 and 2 under a high load, the amount of heat to be processed by the refrigerant system that is selectively operated (in other words, an operating refrigerant system that is continued to be operated) is increased, and therefore the compressor frequency of the operating refrigerant system rises. Thus, the compressor frequency of the operating refrigerant system approaches the frequency F0, at which the overall adiabatic efficiency is high, and operating efficiency can be improved. Therefore, operating efficiency of the refrigerant system under a high load (which is consuming a higher power) increases, and the power consumption can be reduced by a large amount. As a result, it is possible to reduce the total power consumption.

However, if the compressor frequency of the operating refrigerant system after performing the system-selective operation exceeded the frequency F0, at which the overall adiabatic efficiency is high, operating efficiency would not increase. Therefore, whether improvement of operating efficiency is possible by performing a system-selective operation is determined by checking whether the compressor frequency F_s of the operating refrigerant system after performing the system-selective operation becomes lower than or equal to the frequency F0, at which the overall adiabatic efficiency is high. Then, the system-selective operation is performed.

When one of the refrigerant systems under a high load (the operating refrigerant system) is selectively operated, the air-conditioned zone of the other refrigerant system under a low load (stopped refrigerant system) is not sufficiently air-conditioned while the system-selective operation is being performed. Thus, in order to air-condition the air-conditioned zone of the stopped refrigerant system, the circulators 40 corresponding to the operating refrigerant system are operated. Thus, energy saving due to a high-efficiency operation and comfort in the room 100 are both realized.

Figure 6:
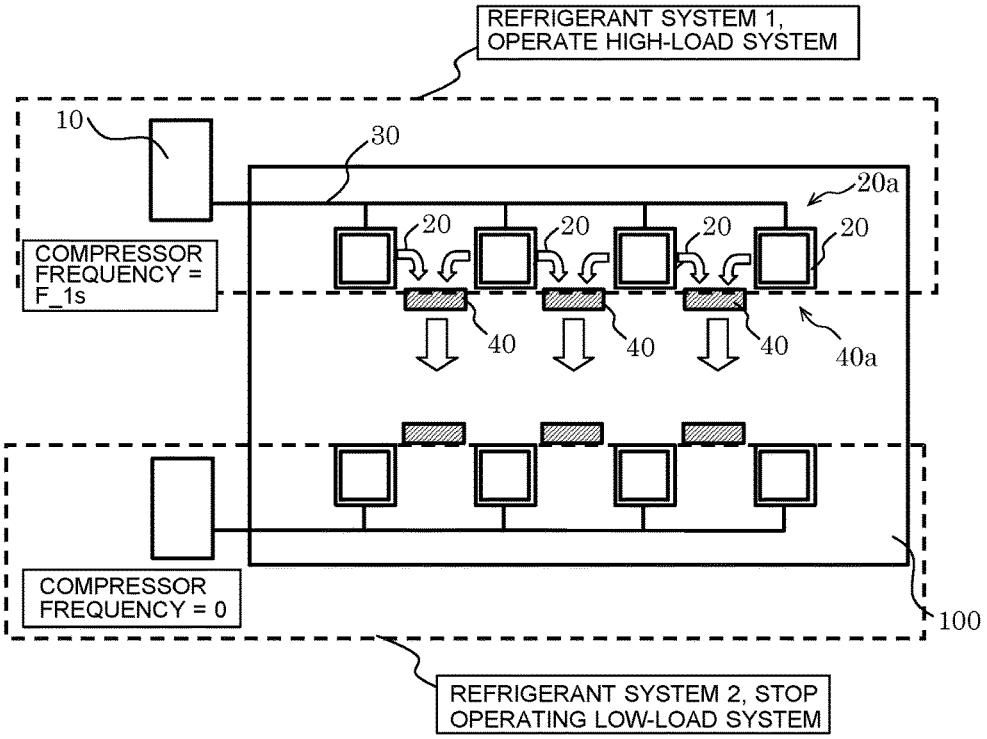
FIG. 6 schematically illustrates an operation that is performed when it is determined that a refrigerant system 1 is under a high load.

FIG. 6 schematically illustrates an operation that is performed when it is determined that the refrigerant system 1 is under a high load.

If the refrigerant system 1 is under a high load, a system-selective operation is performed so as to selectively operate the refrigerant system 1. In other words, while continuing the operation of the refrigerant system 1, the compressor frequency of the refrigerant system 2 under a low load is made to be 0 to stop the refrigerant system 2. Then, the circulators 40*a* disposed in the vicinity of the refrigerant system 1 under a high load are operated. The circulators 40*a* draw blown air (conditioned air) blown by the indoor units 20*a* in operation, and blow the air toward the air-conditioned zone of the refrigerant system 2 which has been stopped. Thus, it is possible to transport conditioned air (heat) to the air-conditioned zone of the refrigerant system 2, which has been stopped.

Figure 7:
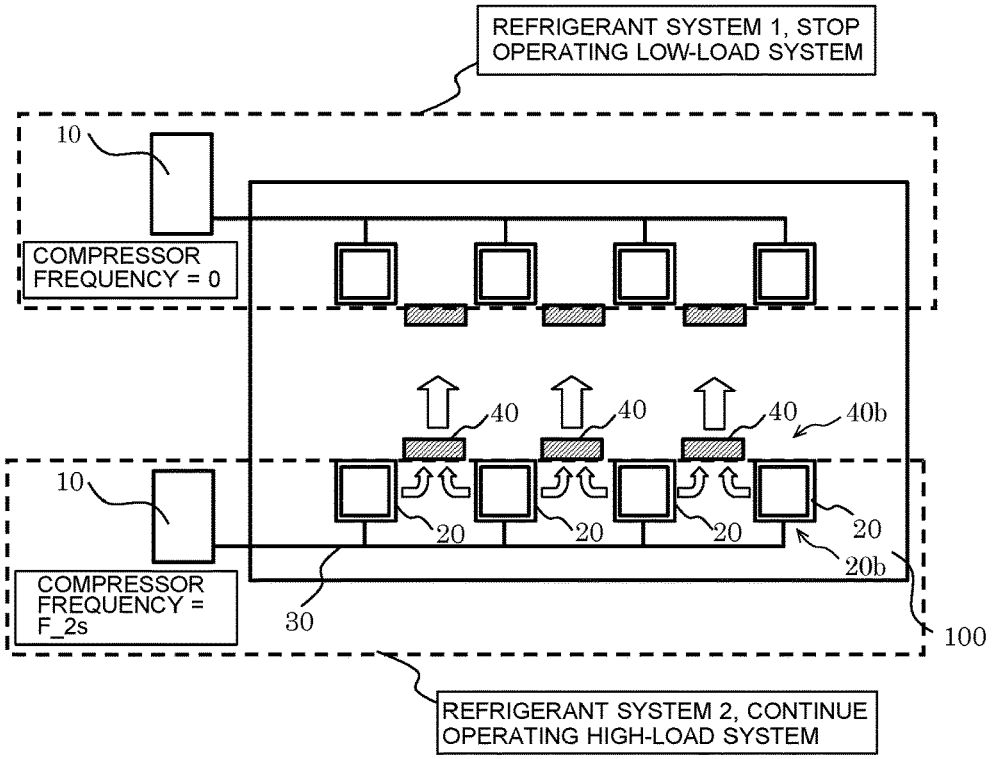
FIG. 7 schematically illustrates an operation that is performed when it is determined that a refrigerant system 2 is under a high load.

Likewise, if it is determined that the refrigerant system 2 is under a high load, an operation can be performed as illustrated in FIG. 7.

Advantages obtained by selectively operating the refrigerant system under a high load include, as described above, an advantage in that the power consumption can be reduced by a large amount and an advantage in that the temperature distribution in the room 100 can be made uniform. If the refrigerant system under a low load were selectively operated, because the room temperature in a low-load zone would easily reach a set temperature, the mode of the refrigerant system under a low load would become the thermo OFF mode before the room temperature of a high-load zone reaches the set temperature, and therefore it would not possible to transport conditioned air (heat) to the high-load zone. As a result, a temperature difference between the high-load zone and the low-load zone would occur, and nonuniform temperature distribution would occur.

In contrast, in the case where the refrigerant system under a high load is selectively operated, since the room temperature of a low-load zone has reached a set temperature when the room temperature of a high-load zone reaches the set temperature, the mode of the refrigerant system under a high load does not become the thermo OFF mode before the room temperature of the low-load zone reaches the set temperature. Thus, it is possible to prevent occurrence of nonuniform temperature distribution and make the temperature distribution in the room 100 uniform.

Figure 8:
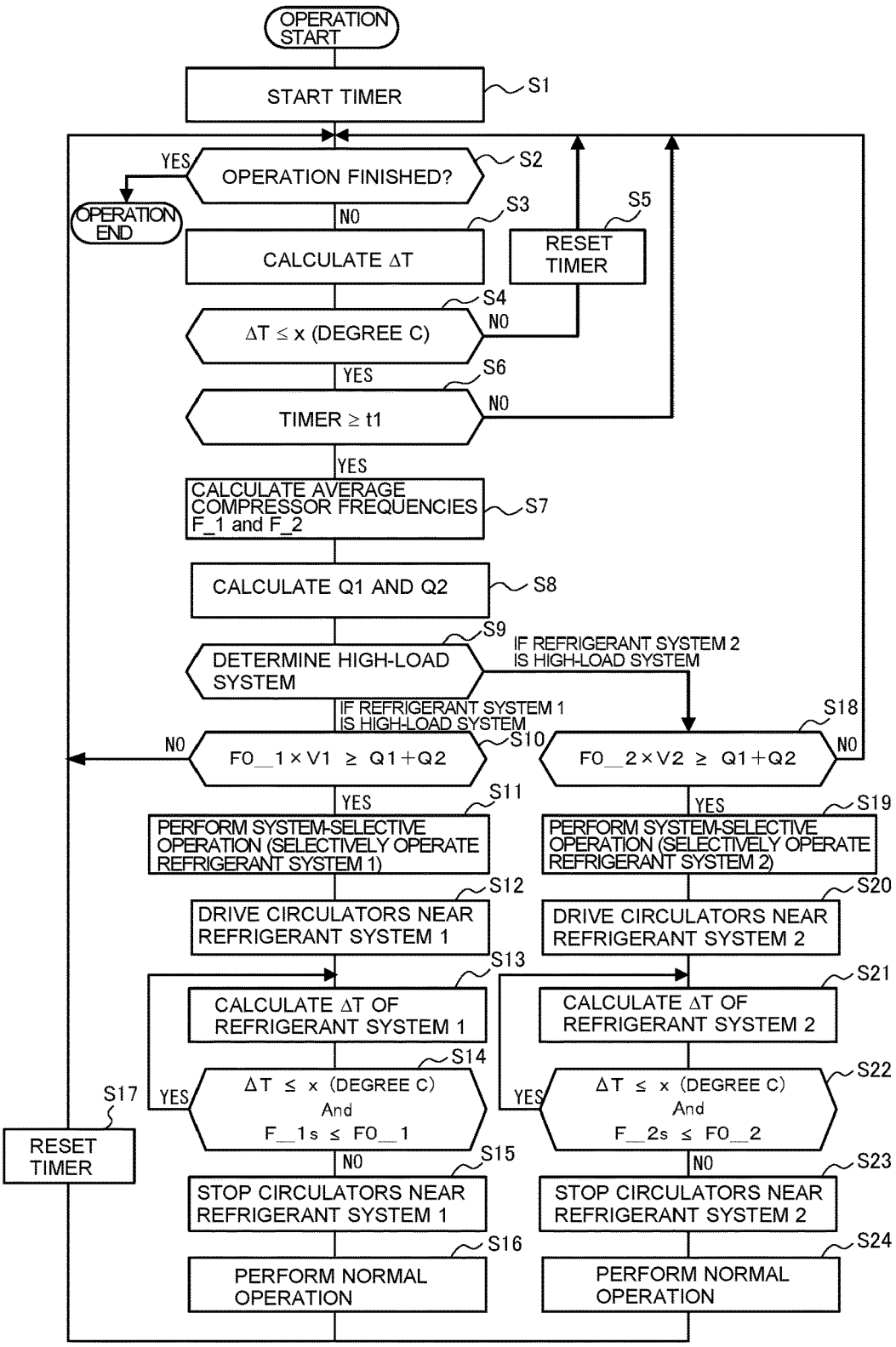
FIG. 8 is a flowchart of a system-selective operation of the air-conditioning apparatus according to Embodiment 1 of the present invention.

FIG. 8 is a flowchart of a system-selective operation of the air-conditioning apparatus according to Embodiment 1 of the present invention.

Upon receiving an operation command, the integrated controller 201 starts a normal operation (cooling or heating) and starts a timer (S1). The timer measures the elapse of a system-selective-operation determination time t1, which is used to calculate the average compressor frequencies F_1 and F_2 of the refrigerant systems 1 and 2 in step S7 described below. If the operation has not been finished (S2), each of the indoor units 20 calculates ΔT (degrees C.), which is represented by expressions (1) and (2) (S3).

If ΔT (degrees C.) is larger than a predetermined value x (degrees C.) for all indoor units 20 (S4), that is, if the temperature load of the room 100 is large, the timer is reset (S5), the process returns to S2, and the timer is restarted. Steps S1 to S5 are repeated until ΔT (degrees C.) becomes smaller than or equal to a preset temperature x (degrees C.) for all indoor units 20.

By performing determination in step S4 so that the process proceeds to the next step if ΔT [degrees C.] is smaller than or equal to a certain value x (degrees C.), such as 1 degree C., when, for example, starting the operation of the air-conditioning apparatus, the operation can be switched between a normal operation and a system-selective operation depending on whether the temperature load of the room 100 is large or small. In the temperature load of the room 100 is large, the normal operation is continued by repeatedly performing steps S1 to S5, and the room temperature can reach the set temperature in a short time.

When the room temperature approaches a set temperature due to the normal operation and ΔT (degrees C.) becomes smaller than or equal to x (degrees C.) for all indoor units 20, whether the timer has elapsed the system-selective-operation determination time t1 is determined (S6), and if not, the process returns to S2. If the timer has elapsed the system-selective-operation determination time t1, a process is started to determine whether a high-efficiency operation is possible by changing the operation from a normal operation to a system-selective operation, that is, whether or not to perform the system-selective operation.

First, the average compressor frequency F_1 (Hz) of the refrigerant system 1 from the present time to t1 and the average compressor frequency F_2 (Hz) of the refrigerant system 2 from the present time to t1 are calculated (S7).

By using these calculation results, a load Q1 on the refrigerant system 1 and a load Q2 on the refrigerant system 2 are calculated (S8). The method of calculating a load is as follows.

The load Q1 on the refrigerant system 1 and the load Q2 on the refrigerant system 2 are calculated by using expressions (6) and (7).

$$Q1=F_1\times V1 \tag{6}$$

$$Q2=F_2\times V2 \tag{7}$$

Here,

V1 ($m^3$): stroke volume of compressor of refrigerant system 1

V2 ($m^3$): stroke volume of compressor of refrigerant system 2

The integrated controller 201 compares the calculated values of Q1 with Q2, and determines which of the refrigerant systems is under a high load (S9).

If Q1 is larger than or equal to Q2 and it is determined that the refrigerant system 1 is under a high load, the process proceeds to S10. If Q1 is smaller than Q2 and it is determined that the refrigerant system 2 is under a high load, the process proceeds to S18.

If it is determined that the refrigerant system 1 is under a high load and the process proceeds to S10, whether the current state of the load satisfies expression (8) is determined. If expression (8) is satisfied, a system-selective operation is performed so as to selectively operate the refrigerant system 1. On the other hand, if it is determined that the refrigerant system 2 is under a high load and the process proceeds to S18, whether the current state of the load satisfies expression (9) is determined. If expression (9) is satisfied, a system-selective operation is performed so as to selectively operate the refrigerant system 2 (S19).

$$F0_1\times V1\geq Q1+Q2 \tag{8}$$

$$F0_2\times V2\geq Q1+Q2 \tag{9}$$

Figure 9:
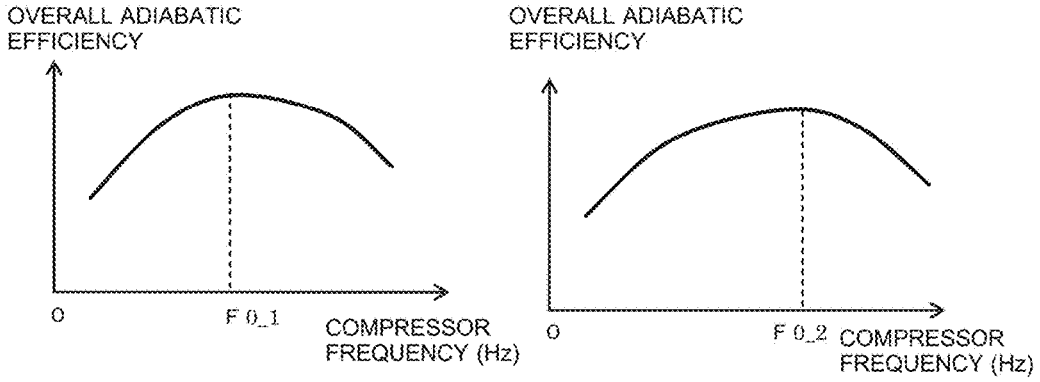
FIG. 9 illustrates the compressor frequency-overall adiabatic efficiency characteristics of compressors of the refrigerant system 1 and the refrigerant system 2.

Here, it is assumed that the characteristic of the compressor 11 of the refrigerant system 1 and the characteristic of the compressor 11 of the refrigerant system 2 respectively have the maximum overall adiabatic efficiency at F0_1 [Hz] and F0_2 [Hz] as illustrated in FIG. 9.

Expressions (8) and (9) correspond to conditions for determining whether a high-efficiency operation is possible by performing a system-selective operation.

A case where expression (8) is satisfied corresponds to a case where, by performing a system-selective operation so as to selectively operate the refrigerant system 1, a compressor frequency F_1 s, which is the compressor frequency of the refrigerant system 1 after the system-selective operation is performed, is increased from a compressor frequency F_1, which is the compressor frequency of the refrigerant system 1 before the system-selective operation is performed, and approaches F0_1. Therefore, if expression (8) is satisfied, by performing a system-selective operation so as to selectively operate the refrigerant system 1, it is certain that operating efficiency can be increased from that before performing the system-selective operation.

A case where expression (8) is not satisfied indicates to a case where the compressor frequency F_1 s exceeds F0_1. Accordingly, if expression (8) is not satisfied, a high-efficiency operation is not expected by performing a system-selective operation. Therefore, a system-selective operation, in which the refrigerant system 1 is selectively operated, is not performed and the current normal operation is continued.

The same applies to a case where expression (9) is satisfied. If expression (9) is satisfied, improvement of operating efficiency is possible by performing a system-selective operation so as to selectively operate the refrigerant system 2. If expression (9) is not satisfied, improvement of operating efficiency is not expected by performing a system-selective operation. Therefore, a system-selective operation, in which the refrigerant system 2 is selectively operated, is not performed and the current normal operation is continued.

Even if F_1 s is larger than or equal to F0_1 or F_2s is larger than or equal to F0_2, it may be determined that improvement of operating efficiency is possible if F_1 s is within a certain frequency range from F0_1 or F0_2. To be specific, the range for performing a system-selective operation may be extended by multiplying the left sides of expression (8) or (9) by a constant α (1 or larger) to make the upper limit of F_1 s or F_2s to be a compressor frequency higher than F0_1 or F0_2.

If it is determined in S9 that the refrigerant system 1 is under a high load and the determination in S10 is YES, a system-selective operation is performed so as to selectively operate the refrigerant system 1 (S11). In other words, as illustrated in FIG. 6, the operation of the refrigerant system 1 under a high load is continued, while the operation of the refrigerant system 2 under a low load is stopped. Then, the circulators 40*a*, which are disposed in the vicinity of the indoor units 20 of the refrigerant system 1 under a high load are operated (S12), so that the circulators 40*a* draw blown air (conditioned air) blown from the indoor units 20*a* in operation and blow the air toward the air-conditioned zone of the refrigerant system 2, which has been stopped. Thus, it is possible to efficiently transport conditioned air (heat) to the air-conditioned zone of the refrigerant system 2 and to make the room temperature uniform.

The temperature difference ΔT (degrees C.) of the refrigerant system 1 is calculated (S13), and, while ΔT (degrees C.) is smaller than or equal to a predetermined value x (degrees C.) (for example, 1 degree C.) and expression (10) is satisfied, the system-selective operation is continued (S13, S14). In other words, the system-selective operation is continued while the current temperature load of the room 100 is a low load, the current compressor frequency F_1s of the refrigerant system 1 continues to be smaller than or equal to F0_1, and a high-efficiency operation is performed.

$$F_1s \leq F0_1 \tag{10}$$

If the determination in S14 becomes NO due to, for example, a change in the temperature environment of the room 100, the circulators 40*a* are stopped (S15), the system-selective operation is stopped, and the operation returns to a normal operation (S16). Then, the timer is reset (S17), the timer is restarted, and the process returns to S2.

If it is determined in S9 that the refrigerant system 2 is under a high load and if the determination in S18 is YES, a system-selective operation is performed so as to selectively operate the refrigerant system 2 (S19). In other words, as illustrated in FIG. 7, while the operation of the refrigerant system 2 under a high load is continued, the operation of the refrigerant system 1 under a low load is stopped. Then, the circulators 40*b*, which are disposed in the vicinity of the indoor units 20 of the refrigerant system 2 under a high load are operated (S20), so that the circulators 40*b* draw blown air (conditioned air) blown from the indoor units 20*b* in operation and blow the air toward the air-conditioned zone of the refrigerant system 1, which has been stopped. Thus, it is possible to efficiently transport conditioned air (heat) to the air-conditioned zone of the refrigerant system 1 and to make the room temperature uniform.

The temperature difference ΔT (degrees C.) of the refrigerant system 2 is calculated, and, while ΔT (degrees C.) is smaller than or equal to a predetermined value x (degrees C.) (for example, 1 degree C.) and expression (11) is satisfied, the system-selective operation is continued (S21, S22). In other words, the system-selective operation is continued while the current temperature load of the room 100 is a low load, the current compressor frequency F_2s of the refrigerant system 2 continues to be smaller than or equal to F0_2, and a high-efficiency operation is performed.

$$F_2s \leq F0_2 \tag{11}$$

If the determination in S22 becomes NO due to, for example, a change in the temperature environment of the room 100, the circulators 40*b* are stopped (S23), the system-selective operation is stopped, and the operation returns to a normal operation (S24). Then, the timer is reset (S17), the timer is restarted, and the process returns to S2.

As heretofore described, according to Embodiment 1, during a low load operation, one of the refrigerant systems 1 and 2 under a high load is selectively operated, so that it is possible to improve the compressor operating efficiency and reduce power consumption. Moreover, the circulators 40 that are disposed in the vicinity of the indoor units 20 of the refrigerant system under a high load are operated to transport conditioned air that has been conditioned by the refrigerant system under a high load (operating refrigerant system) to the air-conditioned zone of the refrigerant system under a low load (stopped refrigerant system), so that it is possible to efficiently transport heat to the air-conditioned zone of the stopped refrigerant system. As a result, it is possible to make the distribution of room temperature uniform and improve energy-saving performance without impairing comfort.

Installation of circulators can be conducted in a period shorter than and at a cost lower than rearrangement of outdoor units and indoor units. Therefore, while maintaining comfort, the power consumption of an air-conditioning apparatus can be reduced in a shorter installation period and at a lower cost than those of existing techniques, in which the arrangement of indoor units are changed so as to dispose indoor units of different systems adjacent to each other.

(Modification of Load Determination)

In the above description, the load is determined on the basis of the average compressor frequencies of the refrigerant systems 1 and 2 by using expressions (6) and (7). Instead of this determination method, any of the determination methods (A) to (E) described below may be used to determine the load.

Figure 10:
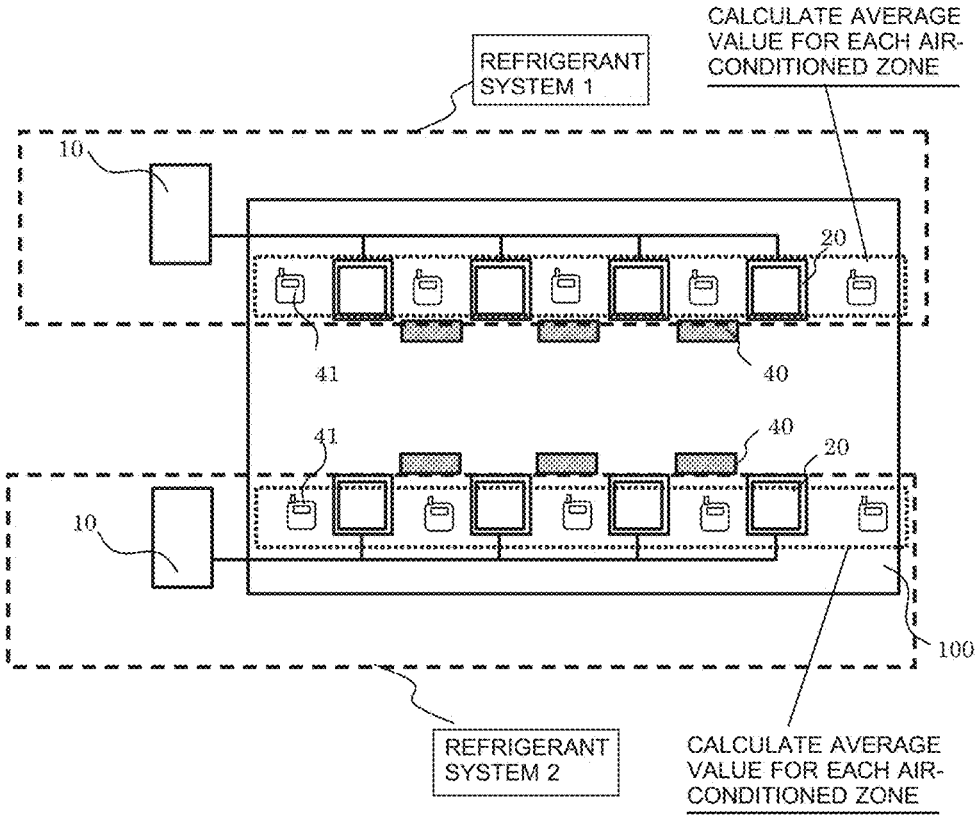
FIG. 10 illustrates modification (A) of load determination.

(A) As illustrated in FIG. 10, load determination may be performed by disposing a plurality of thermometers 41, which serve as the load detection devices 31, in a living space. In this case, the average value of temperatures measured by the thermometers 41 in the air-conditioned zone of one of the refrigerant systems is compared with the average value of temperatures measured by the thermometers 41 in the air-conditioned zone of the other refrigerant system. During a cooling operation, it is determined that one of the refrigerant systems for which the average value is larger is under a high load, and it is determined that the other refrigerant system for which the average value is smaller is under a low load. During a heating operation, it is determined that one of the refrigerant system for which the average value is smaller is under a high load, and it is determined that the other refrigerant system for which the average value is larger is under a low load.

Figure 11:
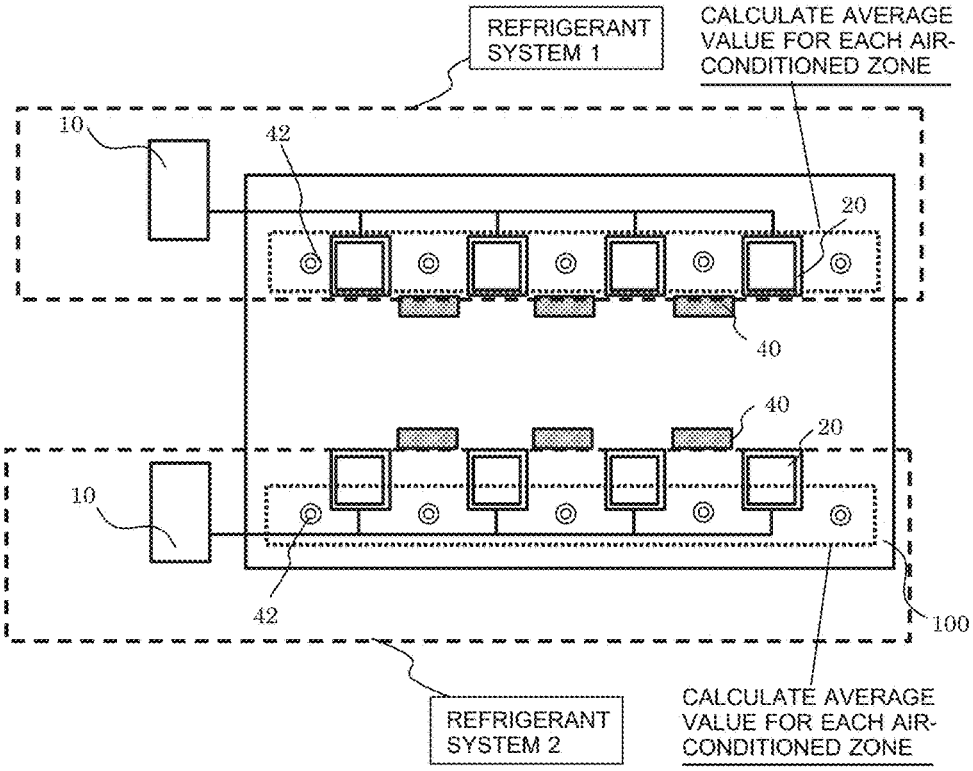
FIG. 11 illustrates modification (B) of load determination.

(B) As illustrated in FIG. 11, load determination may be performed by measuring the temperature of the floor by using radiation thermometers 42, which serve as the load detection devices 31. In this case, the average value of temperatures measured by the radiation thermometers 42 in the air-conditioned zone of one of the refrigerant systems is compared with the average value of temperatures measured by the radiation thermometers 42 in the air-conditioned zone of the other refrigerant system. During a cooling operation, it is determined that one of the refrigerant systems for which the average value is larger is under a high load, and it is determined that the other refrigerant system for which the average value is smaller is under a low load. During a heating operation, it is determined that one of the refrigerant systems for which the average value is smaller is under a high load, and it is determined that the other refrigerant system for which the average value is larger is under a low load.

Figure 12:
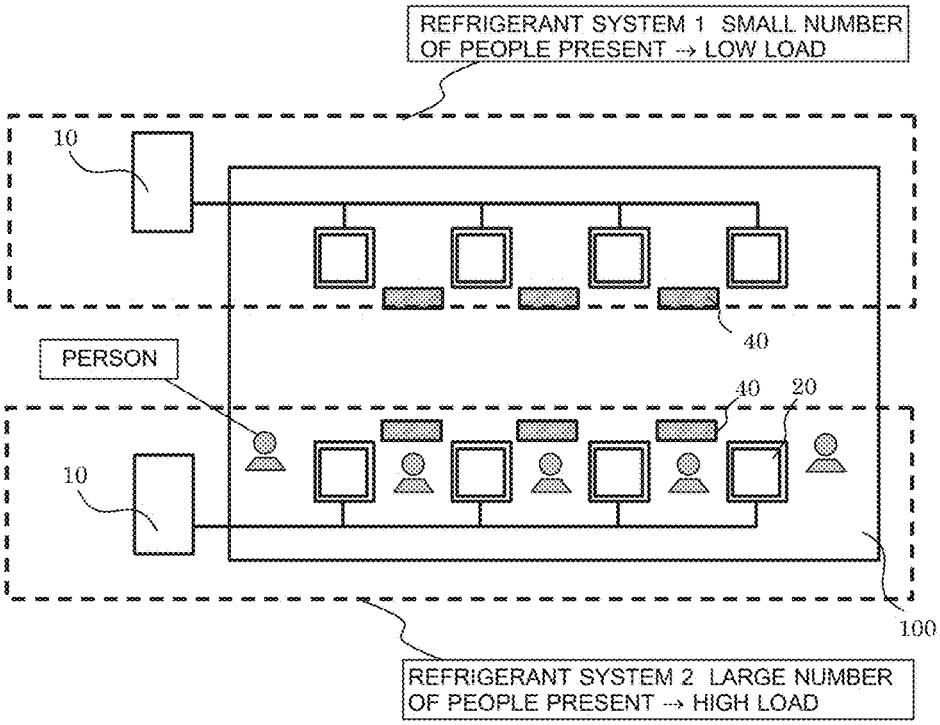
FIG. 12 illustrates modification (C) of load determination.

(C) As illustrated in FIG. 12, load determination may be performed on the basis of information about the number of people present. In this case, during a cooling operation, it is determined that one of the refrigerant systems in the air-conditioned zone of which a larger number of people are present is under a high load, and it is determined that the other refrigerant system in the air-conditioned zone of which a smaller number of people are present is under a low load. During a heating operation, it is determined that one of the refrigerant systems in the air-conditioned zone of which a smaller number of people are present is under a high load, and it is determined that the other refrigerant system in the air-conditioned zone of which a larger number of people are present is under a low load. FIG. 12 illustrates a case where, during a cooling operation, a larger number of people are present in the air-conditioned zone of the refrigerant system 2. In this case, it is determined that the refrigerant system 2 is under a high load and the refrigerant system 1 is under a low load. The information about the number of people present may be detected by using any appropriate method, as long as number-of-people-information detection devices, which serve as the load detection devices 31, can detect the number of people in the air-conditioned zones of the refrigerant systems 1 and 2 by using the method.

Figure 13:
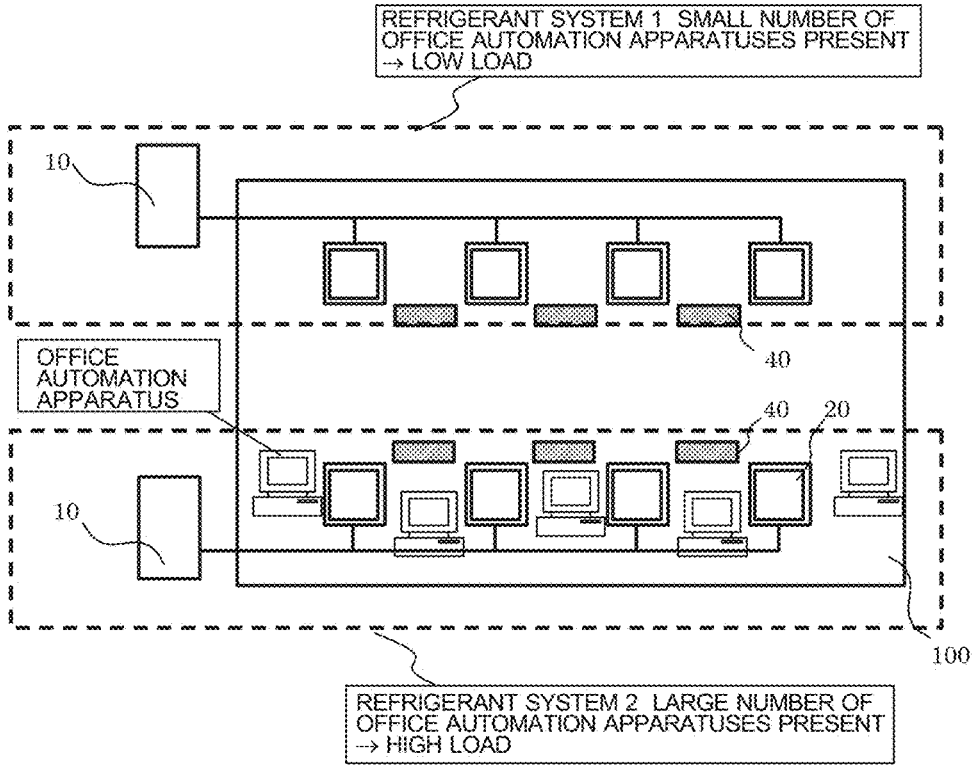
FIG. 13 illustrates modification (D) of load determination.

(D) As illustrated in FIG. 13, load determination may be performed on the basis of the operating state of office automation apparatuses. In this case, during a cooling operation, it is determined that one of the refrigerant systems in the air-conditioned zone of which a larger number of office automation apparatuses are operating is under a high load, and it is determined that the other refrigerant system in the air-conditioned zone of which a smaller number of office automation apparatuses are operating is under a low load. During a heating operation, it is determined that one of the refrigerant systems in the air-conditioned zone of which a smaller number of office automation apparatuses are operating is under a high load, and it is determined that the other refrigerant system in the air-conditioned zone of which a larger number of office automation apparatuses are operating is under a low load. FIG. 13 illustrates a case where, during a cooling operation, a larger number of office automation apparatuses are operating in the air-conditioned zone of the refrigerant system 2. In this case, it is determined that the refrigerant system 2 is under a high load and the refrigerant system 1 is under a low load. The operating state of office automation apparatuses may be detected by using any appropriate method, as long as an office-automation-apparatus-operating-state detection devices (not shown), which serve as the load detection devices 31, can detect the operating state of office automation apparatuses in the air-conditioned zones of the refrigerant systems 1 and 2.

Figure 14:
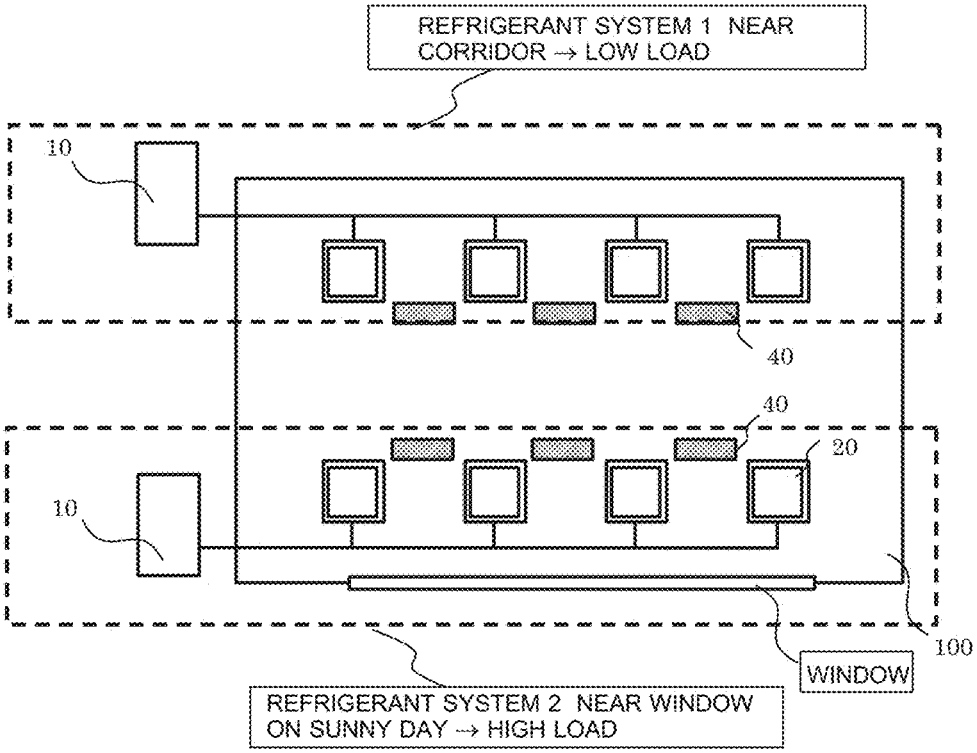
FIG. 14 illustrates modification (E) of load determination.

(E) As illustrated in FIG. 14, load determination may be performed on the basis of the weather (the amount of sunshine) and the position of a window. In this case, if the weather is sunny during a cooling operation, it is determined that one of the refrigerant systems disposed near the window is under a high load, and it is determined that the other refrigerant system disposed near a corridor is under a low load. If the weather is sunny during a heating operation, it is determined that one of the refrigerant systems disposed near the window is under a low load, and it is determined that the other refrigerant system disposed near the corridor is under a high load. FIG. 14 illustrates an example in which the refrigerant system 2 is near a window and a cooling operation is performed. In this case, it is determined that the refrigerant system 2 is under a high load and the refrigerant system 1 is under a low load. The amount of sunshine may be detected by using any appropriate method, as long as sunshine-amount detection devices, which serve as the load detection devices 31, can detect the amount of sunshine.

Figure 15:
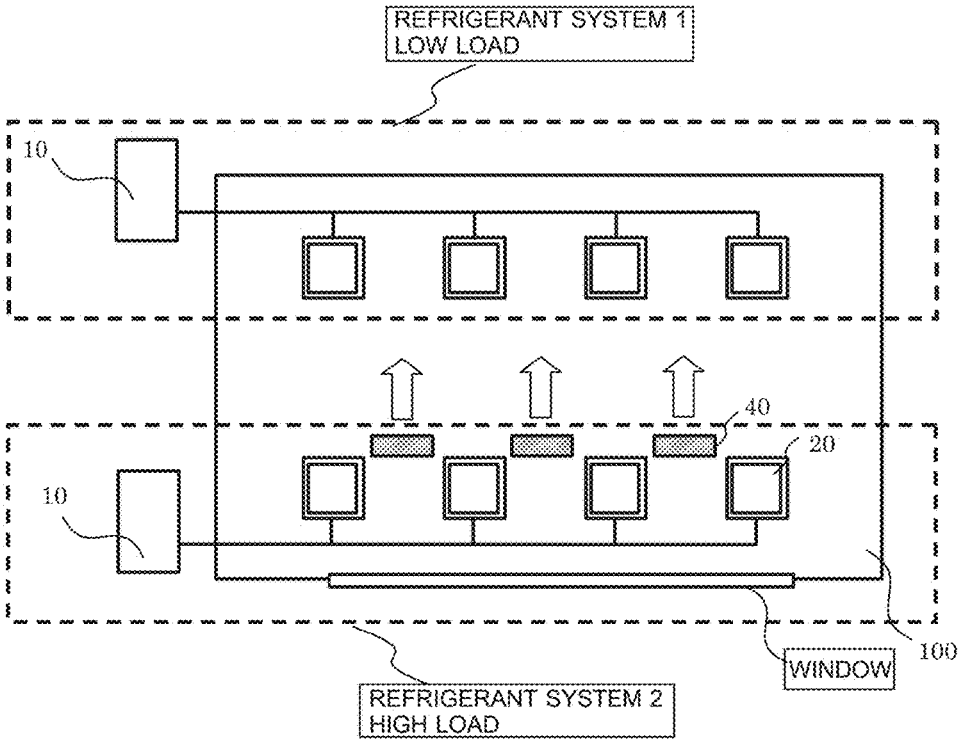
FIG. 15 illustrates an example of arrangement of circulators.

In Embodiment 1, each of the refrigerant systems is provided with the circulators 40. However, as illustrated in FIG. 15, if it is known beforehand which of the refrigerant systems operates under a high load, such as in a case where one of the refrigerant systems is disposed near a window, the circulators 40 may be disposed near the indoor units 20 of only the refrigerant system operated under a high load.

Embodiment 2

In Embodiment 1 described above, the system-selective operation is applied to an air-conditioning apparatus including two systems. In Embodiment 2 described below, the system-selective operation is applied to an air-conditioning apparatus including three systems. Note that modifications of Embodiment 1 is also applicable to the modification corresponding portions of Embodiment 2.

Figure 16:
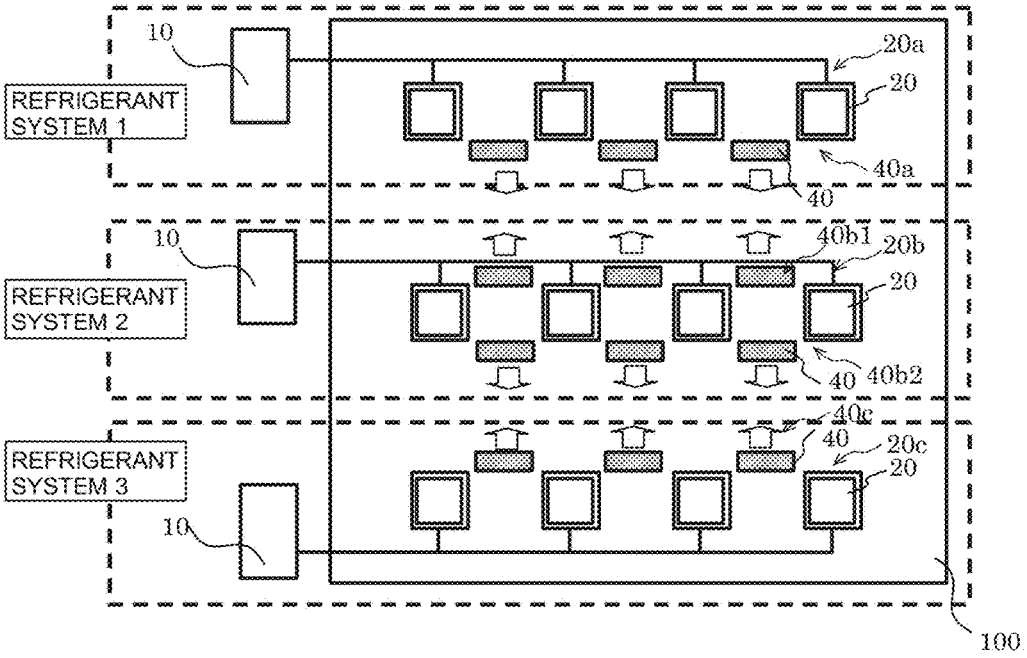
FIG. 16 is a floor plan view of a building in which an air-conditioning apparatus according to Embodiment 2 of the present invention is installed.

FIG. 16 is a floor plan view of a building in which an air-conditioning apparatus according to Embodiment 2 of the present invention is installed.

The air-conditioning apparatus according to Embodiment 2 includes three refrigerant systems, which are a refrigerant system 1, a refrigerant system 2, and a refrigerant system 3. The three refrigerant systems air-condition a single room 100. Each of the refrigerant systems 1, 2, and 3 includes an outdoor unit 10 and indoor units 20, which are connected to the outdoor unit 10 through a refrigerant pipe 30. The air-conditioning apparatus further includes a plurality of (here, three or six) circulators 40, which are provided for each of the refrigerant systems. Hereinafter, for the sake of identification, the indoor units 20 of the refrigerant system 1 may be referred to as indoor unit 20*a*, the circulators 40 for the refrigerant system 1 may be referred to as circulators 40*a*, the indoor units 20 of the refrigerant system 2 may be referred to as indoor unit 20*b*, the circulators 40 for the refrigerant system 2 may be referred to as circulators 40*b*1 and 40*b*2, the indoor units 20 of the refrigerant system 3 may be referred to as indoor unit 20*c*, and the circulators 40 for the refrigerant system 3 may be referred to as circulators 40*c*.

In the respective refrigerant systems 1, 2, and 3, the indoor units 20*a*, 20*b*, 20*c* are linearly arranged on the ceiling of the room 100 with distances therebetween. The indoor units 20*a*, 20*b*, 20*c* respectively air-condition three air-conditioned zones formed by dividing the room 100 into three in one direction. The circulators 40*a* and 40*c*, which are provided for the refrigerant systems 1 and 3 at both ends of the room 100, are disposed so that the circulators 40*a* and 40*c* can respectively draw blown air from the indoor units 20*a* and 20*c* of the corresponding refrigerant system 1 and 3 and blow the air toward the center of the room. The circulators 40*b*1 and 40*b*2, which are provided for the refrigerant system 2 at the center, are respectively disposed near the indoor units 20 of the refrigerant system to which they belong so that the circulators 40*b*1 and 40*b*2 respectively transport air toward the air-conditioned zones of the refrigerant systems 1 and 3 at both ends.

In Embodiment 2, which has the structure described above, a system-selective operation is performed basically by using a method the same as that of Embodiment 1. Hereinafter, the difference between the method for performing a system-selective operation in a case where the number of refrigerant systems is three and the method of Embodiment 1 will be described.

First, a load on each of the three refrigerant systems 1, 2, and 3 is measured in the same way as in Embodiment 1 to determine a low-load system, an intermediate-load system, and a high-load system. If it is determined that improvement of operating efficiency is expected by performing a system-selective operation, the low-load system is stopped, and a system-selective operation is performed so as to selectively operate the refrigerant systems determined to be an intermediate-load system or a high-load system. Hereinafter, an overview of a system-selective operation that is performed in a case where the low-load system is one of the refrigerant systems 1 and 3 at both ends and a system-selective operation that is performed in a case where the low-load system is the refrigerant system 2 at the center will be described in this order.

(Case where Low-Load System is One of Refrigerant System 1 and 3 at Both Ends)

Figure 17:
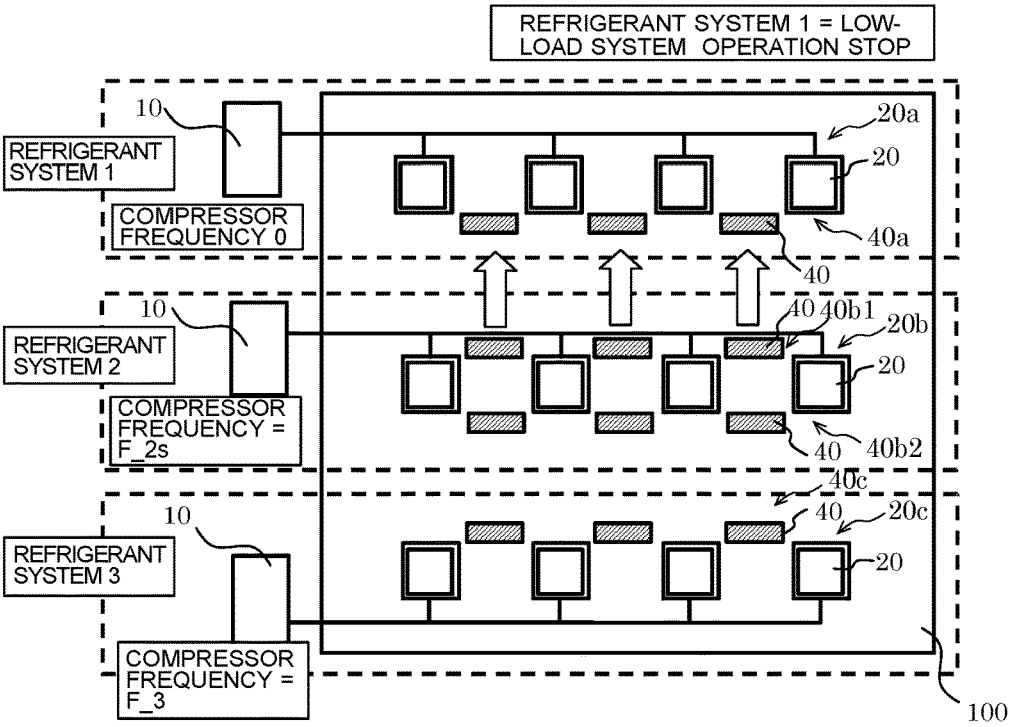
FIG. 17 schematically illustrates an operation that is performed when a low-load system is a refrigerant system 1.

FIG. 17 schematically illustrates an operation that is performed when the low-load system is the refrigerant system 1.

In this case, if it is determined that improvement of operating efficiency is expected by selectively operating the refrigerant system 2 than by operating both of the low-load system and the refrigerant system 2 at the center, a system-selective operation is performed so as to selectively operate the refrigerant system 2. In other words, as illustrated in FIG. 17, while the operation of the refrigerant system 2 is continued, the compressor frequency of the refrigerant system 1, which is the low-load system, is made to be 0 to stop the refrigerant system 1. Since the refrigerant system 1 is stopped, the amount of heat to be exchanged by the refrigerant system 2 is increased, the compressor frequency of the refrigerant system 2 increases from F_2, before starting the system-selective operation, to F_2s and approaches the frequency F0_2, at which the overall adiabatic efficiency is high. Thus, a high-efficiency operation is realized. Note that, irrespective of whether the refrigerant system 2 is the intermediate-load system or the high-load system, if the low-load system is one of the refrigerant systems 1 and 3 at both ends, the refrigerant system 2 at the center is selectively operated.

Then, the circulators 40*b*1, which are a group of the circulators 40*b*1 and 40*b*2 corresponding to the refrigerant system 2 at the center, are operated to blow air toward the air-conditioned zone of the refrigerant system 1, which has been stopped. The circulators 40*b*1 draw blown air from the indoor units 20*b* and blow the air toward the air-conditioned zone of the refrigerant system 1.

The operation of the refrigerant system 3, which is disposed at an end opposite to the low-load system, is continued. The refrigerant system 3 is operated with a compressor frequency F_3 on the basis of the temperature difference ΔT between the detection value T of the inlet-air-temperature detection device 21 of each of the indoor units 20*c* and the set temperature T0.

Figure 18:
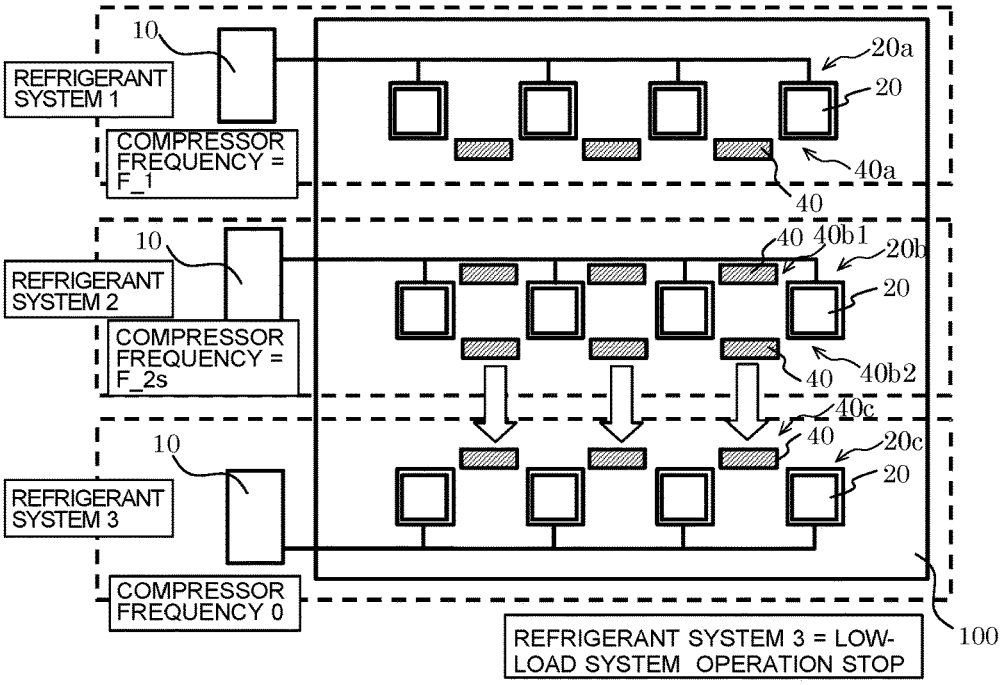
FIG. 18 schematically illustrates an operation that is performed when a low-load system is a refrigerant system 3.

Heretofore, a case where it is determined that the refrigerant system 1 is the low-load system is described. FIG. 18 illustrates an operation that is performed when it is determined that the low-load system is the refrigerant system 3.

(Case where Low-Load System is System at the Center (Refrigerant System 2))

Figure 19:
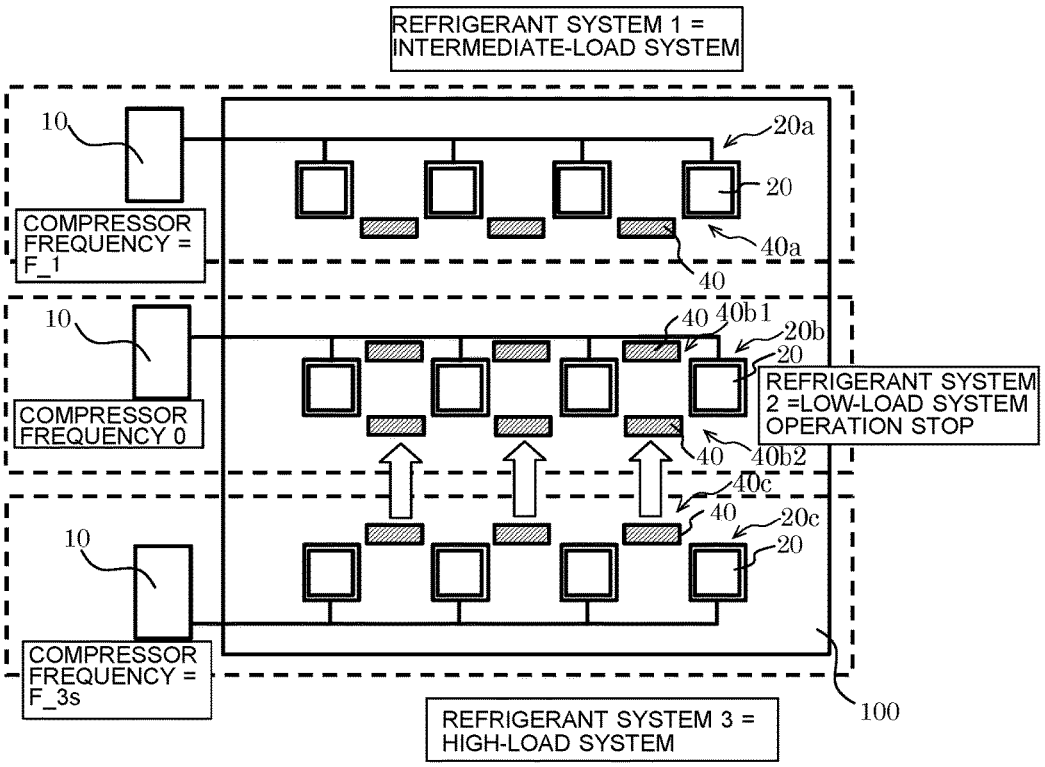
FIG. 19 schematically illustrates a case where a low-load system is a refrigerant system 2 at the center and a system-selective operation is performed so as to selectively operate a high-load system.
Figure 20:
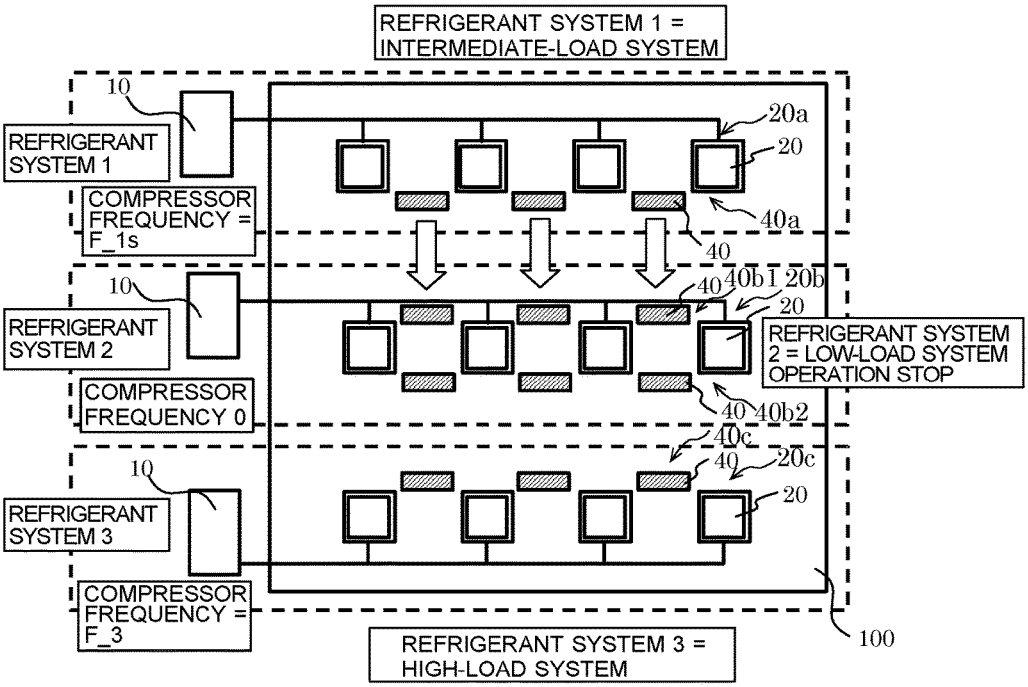
FIG. 20 schematically illustrates an operation that is performed when the low-load system is the refrigerant system 2 at the center, a system-selective operation for selectively operating the high-load system cannot be performed, and a system-selective operation is performed so as to selectively operate an intermediate-load system.

In this case, one of the refrigerant systems 1 and 3 at both ends, that is, one of the high-load system and the intermediate-load system is operated, while the refrigerant system 2 at the center is stopped. If it is determined that improvement of operating efficiency is expected by selectively operating the high-load system, the high-load system is selectively operated. If it is determined that improvement of operating efficiency is not expected by selectively operating the high-load system, the intermediate-load system is selectively operated. If it is determined that improvement of operating efficiency is not expected by selectively operating any one of the high-load system and the intermediate-load system without performing a system-selective operation, and the normal operation is continued. FIGS. 19 and 20 schematically illustrate the operations performed when the low-load system is at the center. FIGS. 19 and 20 illustrate a case where the refrigerant system 3 is the high-load system, and the refrigerant system 1 is the intermediate-load system.

Figure 21:
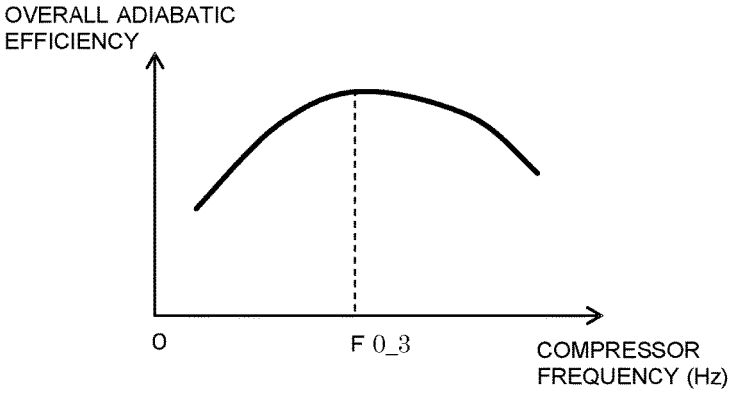
FIG. 21 illustrates the compressor frequency-overall adiabatic efficiency characteristic of a compressor of the refrigerant system 3.

FIG. 19 schematically illustrates a case where the low-load system is the refrigerant system 2 at the center and a system-selective operation is performed so as to selectively operate the high-load system. It is assumed that the compressor of the refrigerant system 3 has a characteristic such that the compressor has the maximum overall adiabatic efficiency at F0_3 [Hz] as illustrated in FIG. 21.

In this case, operation of the refrigerant system 3, which is the high-load system, is continued, while the compressor frequency of the refrigerant system 2, which is the low-load system, is made to be 0 to stop the refrigerant system 2. Since the refrigerant system 2 is stopped, the amount of heat to be exchanged by the refrigerant system 3 is increased, the compressor frequency of the refrigerant system 3 increases from F_3, before starting the system-selective operation, to F_3s and approaches the frequency F0_3, at which the overall adiabatic efficiency is high. Thus, a high-efficiency operation is implemented.

Then, the circulators 40*c*, which correspond to the refrigerant system 3 under a high load, is operated so that the circulators 40*c* draw blown air from the indoor units 20*c* and transport the air toward the air-conditioned zone of the refrigerant system 2, which has been stopped.

The operation of the refrigerant system 1, which is the intermediate-load system, is continued. The refrigerant system 1 is operated at a compressor frequency F_1 on the basis of the temperature difference ΔT between the detection value T of the inlet-air-temperature detection device 21 of each of the indoor units 20*a* and the set temperature T0.

FIG. 20 schematically illustrates an operation that is performed when the low-load system is the refrigerant system 2 at the center, a system-selective operation for selectively operating the high-load system cannot be performed, and a system-selective operation is performed so as to selectively operate the intermediate-load system. Here, it is assumed that the refrigerant system 1 is the intermediate-load system and the refrigerant system 3 is the high-load system.

In this case, operation of the refrigerant system 1, which is the intermediate-load system, is continued, and the compressor frequency of the refrigerant system 2, which is the low-load system, is made to be 0 to stop the refrigerant system 2. Since the refrigerant system 2 is stopped, the amount of heat to be exchanged by the refrigerant system 1 is increased, the compressor frequency of the refrigerant system 1 increases from F_1, before starting the system-selective operation, to F_1s and approaches the frequency F0_1, at which the overall adiabatic efficiency is high. Thus, a high-efficiency operation is implemented.

Then, the circulators 40*a*, which correspond to the refrigerant system 1 under an intermediate load, are operated to draw blown air from the indoor units 20*a* and to transport the air to the air-conditioned zone of the refrigerant system 2, which has been stopped.

The operation of the refrigerant system 3, which is the high-load system, is continued. The refrigerant system 3 is operated with a compressor frequency F_3 on the basis of the temperature difference ΔT between the detection value T of the inlet-air-temperature detection device 21 of each of the indoor units 20*c* and the set temperature T0.

Figure 22:
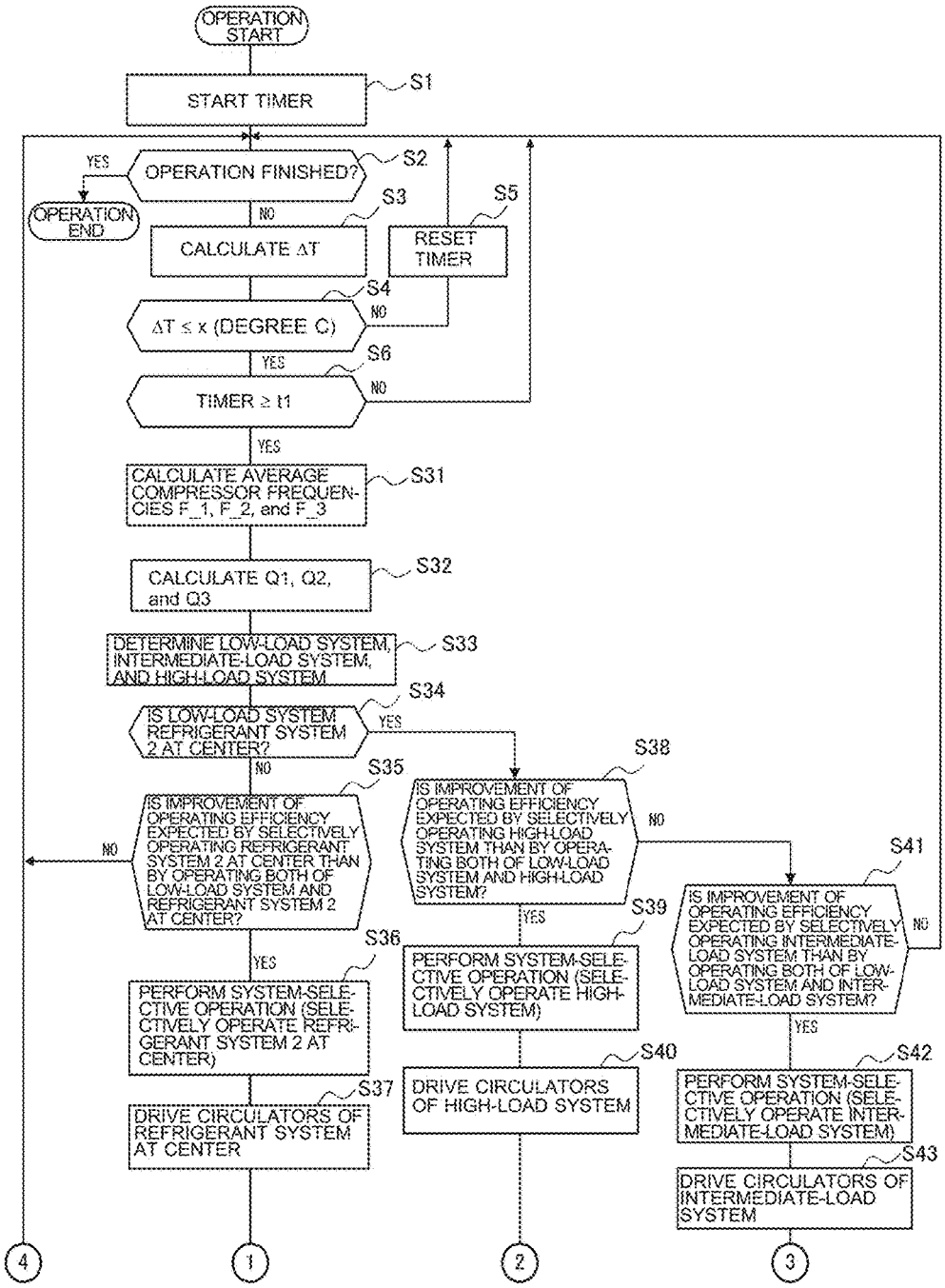
FIG. 22 is a flowchart (1/2) of a system-selective operation of the air-conditioning apparatus according to Embodiment 2 of the present invention.
Figure 23:
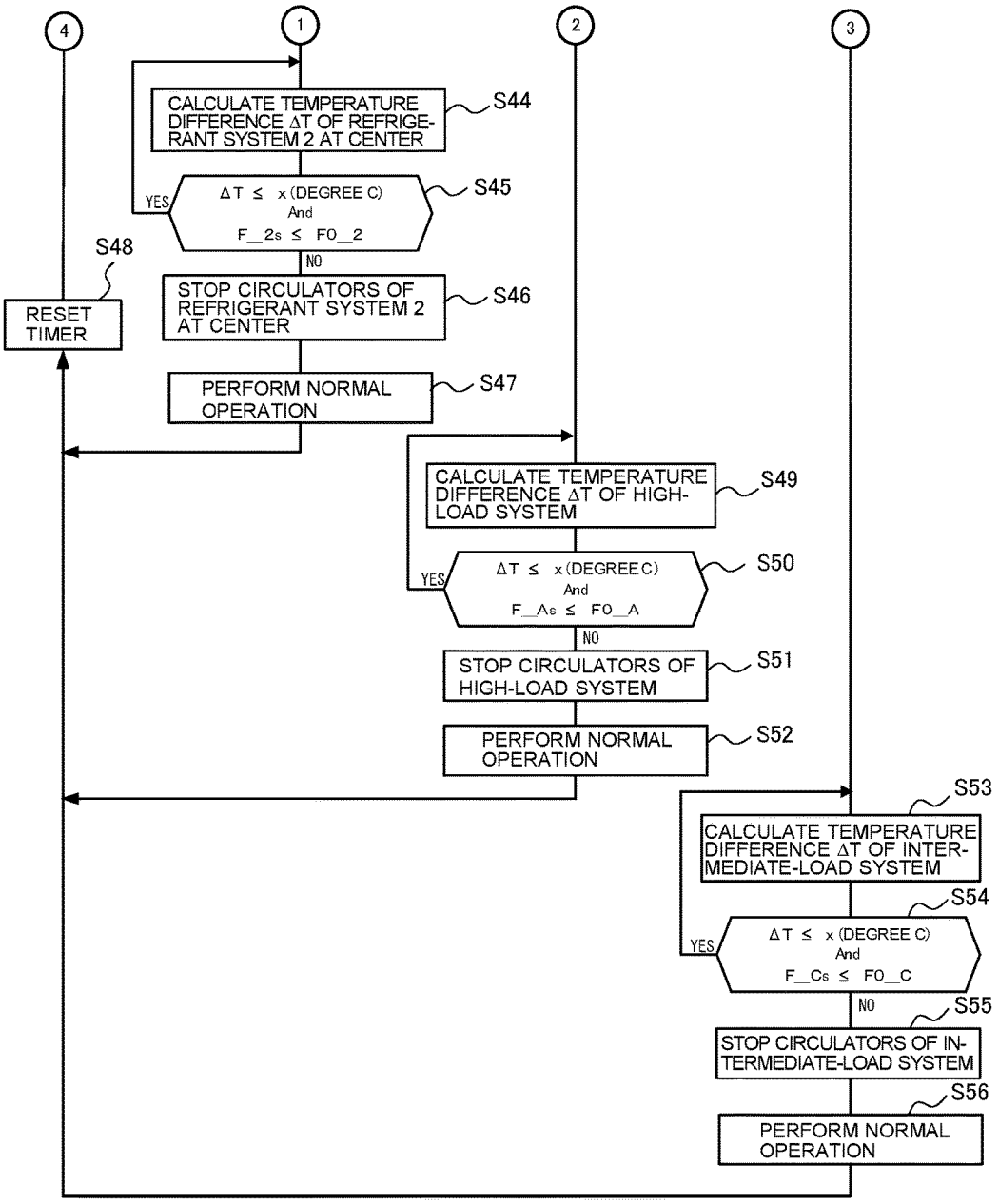
FIG. 23 is a flowchart (2/2) of the system-selective operation of the air-conditioning apparatus according to Embodiment 2 of the present invention.

FIGS. 22 and 23 illustrate a flowchart of a system-selective operation of the air-conditioning apparatus according to Embodiment 2 of the present invention.

Steps S1 to S6 are the same as those of Embodiment 1. For the three refrigerant systems 1, 2, and 3, the integrated controller 201 calculates a load Q1 on the refrigerant system 1, a load Q2 on the refrigerant system 2, and a load Q3 on the refrigerant system 3 by using expressions (6), (7), and (12) in the same way as Embodiment 1 (S31, S32).

$$Q3=F_3\times V3 \tag{12}$$

Here,

F_3 (Hz): average compressor frequency of refrigerant system 3 from the present time to t1

V3 ($m^3$): stroke volume of compressor of refrigerant system 3

The integrated controller 201 compares the calculated values of Q1, Q2, and Q3; and determines which of the refrigerant systems is a high-load system, an intermediate-load system, or a low-load system (S33).

Next, whether the low-load system is the refrigerant system 2 disposed at the center is determined (S34). If the determination in S34 is NO, that is, if the low-load system is one of the refrigerant systems 1 and 3 at both ends, whether or not to perform a system-selective operation is determined (S35). In other words, whether or not improvement of operating efficiency is expected by selectively operating the refrigerant system 2 at the center than by operating both of the low-load system and the refrigerant system 2 at the center is determined. To be specific, when the low-load system is the refrigerant system 1, this can be determined by checking whether expression (9) is satisfied, and when the low-load system is the refrigerant system 3, this can be determined by checking whether expression (13) is satisfied.

$$F0_2\times V2\geq Q2+Q3 \tag{13}$$

If the determination in S35 is YES (if expression (9) or (13) is satisfied), it is determined that improvement of operating efficiency is expected. Then, as illustrated in FIGS. 17 and 18, a system-selective operation is performed so as to selectively operate the refrigerant system 2 at the center (S36), and, among the circulators 40*b*1 and 40*b*2 of the refrigerant system 2, the circulators 40 are operated that transport air toward the air-conditioned zone of the refrigerant system 1 or the refrigerant system 3, which has been stopped (S37). Thus, it is possible to efficiently transport conditioned air (heat) to the air-conditioned zone of the refrigerant system 1 or the refrigerant system 3, which has been stopped, and to make the room temperature uniform.

If the determination in S34 is YES, that is, if the low-load system is the refrigerant system 2 disposed at the center, whether or not to perform a system-selective operation is determined. In other words, first, whether improvement of operating efficiency is expected by selectively operating the high-load system is determined (S38). This can be determined by checking whether a first condition, which is represented by expression (14), is satisfied.

$$F0_A\times VA\geq QA+QB \tag{14}$$

Here,

F0_A: frequency at which overall adiabatic efficiency of compressor of high-load system is maximum VA: stroke volume of compressor of high-load system QA: load on high-load system QB: load on low-load system If the determination in S38 is YES (if the first condition is satisfied), the high-load system is selectively operated (S39). Then, the circulators 40 of the high-load system are operated (S40) to draw blown air blown from the indoor unit 20 in operation and to blow the air toward the air-conditioned zone of the refrigerant system 2, which has been stopped. Thus, it is possible to efficiently transport conditioned air (heat) to the air-conditioned zone of the refrigerant system 2, which has been stopped, and to make the room temperature uniform. When the high-load system is the refrigerant system 3, the operation is performed as illustrated in FIG. 19.

If the determination in S38 is NO (if the first condition is not satisfied), whether improvement of operating efficiency is expected by selectively operating the intermediate-load system is determined (S41). To be specific, this can be determined by checking whether a second condition, which is represented by expression (15), is satisfied.

$$F0_C\times VC\geq QB+QC \tag{15}$$

Here,

F0_C: frequency at which overall adiabatic efficiency of compressor of intermediate-load system is maximum VC: stroke volume of compressor of intermediate-load system QC: load on intermediate-load system If the determination in S41 is YES (if the second condition is satisfied), the intermediate-load system is selectively operated (S42). Then, the circulators 40 of the intermediate-load system are operated (S43) to draw blown air blown from the indoor units 20 in operation and blow air toward the air-conditioned zone of the refrigerant system 2, which has been stopped. Thus, it is possible to efficiently transport conditioned air (heat) to the air-conditioned zone of the refrigerant system 2, which has been stopped, and to make the room temperature uniform. When the intermediate load system is the refrigerant system 1, the operation is performed as illustrated in FIG. 20.

If the determination in S41 is NO (if the second condition is not satisfied), it is determined that improvement of operating efficiency is not possible by selectively operating any one of the high-load system and the intermediate-load system. Therefore, a normal operation is continued without performing a system-selective operation, and the process returns to S2.

The process after S44 is performed in the same way as in Embodiment 1. In other words, in a case where the refrigerant system 2 at the center is selectively operated, the temperature difference ΔT (degrees C.) of the refrigerant system 2 is calculated (S44), and the system-selective operation is continued while the temperature difference ΔT (degrees C.) of the refrigerant system 2 is smaller than or equal to a predetermined value x (degrees C.) (for example, 1 degree C.), the current compressor frequency F_2s of the refrigerant system 2 continues to be smaller than or equal to F0_2, which is the current value, and a high-efficiency operation is being performed (S45).

If the determination in S45 becomes NO due to, for example, a change in the temperature environment of the room 100, the circulators 40*b* are stopped (S46), the system-selective operation is stopped, and the operation returns to a normal operation (S47). Then, the timer is reset (S48), the timer is restarted, and the process returns to S2.

In a case where the high-load system is selectively operated, the temperature difference ΔT (degrees C.) of the high-load system is calculated (S49), and a system-selective operation is continued while the temperature difference ΔT (degrees C.) of the high-load system is smaller than or equal to a predetermined value x (degrees C.) (for example, 1 degree C.), the current compressor frequency F_As of the high-load system continues to be smaller than or equal to F0_A, at which the overall adiabatic efficiency is maximum, and a high-efficiency operation is being performed (S50). If the determination in S50 becomes NO due to, for example, a change in the temperature environment of the room 100, the circulators 40*b* of the high-load system are stopped (S51), the system-selective operation is stopped, and the operation returns to a normal operation (S52). Then, the timer is reset (S48), the timer is restarted, and the process returns to S2.

In a case where the intermediate-load system is selectively operated, the temperature difference ΔT (degrees C.) of the intermediate-load system is calculated (S53), and the system-selective operation is continued while the temperature difference ΔT (degrees C.) of the intermediate-load system is smaller than or equal to a predetermined value x (degrees C.) (for example, 1 degree C.), the current compressor frequency F_Cs of the intermediate-load system continues to be smaller than or equal to F0_C, at which the overall adiabatic efficiency is maximum, and a high-efficiency operation is being performed (S54). If the determination in S54 becomes NO due to, for example, a change in the temperature environment of the room 100, the circulators 40 of the intermediate-load system are stopped (S55), the system-selective operation is stopped, and the operation returns to a normal operation (S56). Then, the timer is reset (S48), the timer is restarted, and the process returns to S2.

As described above, Embodiment 2 has advantages the same as those of Embodiment 1. Moreover, also in the case where the number of refrigerant systems is three, by determining which of the refrigerant systems is under a low load and by selectively operating one of a high-load system and an intermediate load system, which makes it possible to improve the operation efficiency when it is selectively operated, improvement of compressor operating efficiency and reduction of power consumption can be achieved. After the system-selective operation is started, the compressor frequency has a value between the current compressor frequency and the frequency at which the overall adiabatic efficiency is the maximum, so that the efficiency is improved from that before the system-selective operation is performed.

Even if the compressor frequency after performing the system-selective operation is larger than or equal to the frequency at which the overall adiabatic efficiently is maximum, it may be determined that improvement of operating efficiency is possible if the compressor frequency is within a certain frequency range and close to a degree from the frequency at which the overall adiabatic efficiency is maximum. To be specific, the range for performing a system-selective operation may be extended by multiplying the left sides of expressions (13), (14), and (15) by a constant α (1 or larger) to make the upper limit of the compressor frequency after performing the system-selective operation be a compressor frequency higher than the frequency at which the overall adiabatic efficiency is maximum.

The circulators 40 are disposed at positions at which the circulators 40 can draw blown air blow from the indoor units in operation, so that conditioned air (heat) can be efficiently transported.

Advantages obtained by stopping the refrigerant system under a low load and selectively operating the refrigerant system under a high load or the refrigerant system under an intermediate load (by selectively operating the refrigerant system under a high load as long as it is possible) include an advantage in that the power consumption can be reduced due to an improvement of operating efficiency and an advantage in that the temperature distribution in the room 100 can be made uniform. If the refrigerant system under a low load were selectively operated, since the room temperature in a low-load zone would easily reach a set temperature, the mode of the operating refrigerant system would become the thermo OFF mode before the room temperature of a high-load zone or an intermediate-load zone reaches the set temperature, and therefore it would not be possible to transport conditioned air (heat) to the high-load zone or the intermediate-load zone. As a result, a temperature difference between the high-load zone or the intermediate-load zone and the low-load zone would occur, and nonuniform temperature distribution would occur.

In contrast, in the case where the refrigerant system under a high load or a refrigerant system under an intermediate load is selectively operated, because the room temperature of a low-load zone has reached a set temperature when the room temperature of a high-load zone or an intermediate zone reaches the set temperature, the mode of the refrigerant system under a high load or the refrigerant system under an intermediate load does not become the thermo OFF mode before the room temperature of the low-load zone reaches the set temperature. Thus, it is possible to prevent occurrence of nonuniform temperature distribution and make the temperature distribution in the room 100 uniform.

The invention claimed is:

1. An air-conditioning apparatus comprising:

a plurality of refrigerant systems that includes a first refrigerant system and a second refrigerant system, each of the plurality of refrigerant systems including an outdoor unit, and one or more indoor units and configured to air-condition a single room;

one or more circulators provided for each of the plurality of refrigerant systems, the one or more circulators being arranged separately from the one or more indoor units and being configured to make a temperature distribution in the room uniform; and a controller configured to determine a load on each of the plurality of refrigerant systems in operation and control operations of the refrigerant systems and the circulators, wherein the controller is configured to determine whether an improvement in operating efficiency is expected on a basis of the load on each of the plurality of refrigerant systems in operation by:

calculating a product of an operating frequency and a stroke volume of a compressor of the first refrigerant system as Q1, calculating a product of an operating frequency and a stroke volume of a compressor of the second refrigerant system as Q2, calculating a summation of Q1+Q2, determining which of the first refrigerant system and the second refrigerant system is a high load system, calculating a product of a compressor frequency F0 and the stroke volume V of the compressor of the high load system as F0×V, the compressor frequency being a frequency at which overall adiabatic efficiency of the compressor is maximum, determining whether (i) the summation of Q1+Q2 is greater than, equal to, or less than (ii) F0×V, and determining that improvement of operating efficiency is expected in response to a determination that (i) the summation of Q1+Q2 is less than, or equal to, (ii) F0×V; and if the controller determines that improvement of operating efficiency is expected on a basis of the load on each of the plurality of refrigerant systems in operation, the controller is configured to:

perform a system-selective operation in which one of the refrigerant systems determined to be under a low load is stopped and the other refrigerant system determined that a load thereof is higher than the determined low load is selectively performed, and operate one of the circulators provided in an air-conditioned zone of the refrigerant system determined that the load thereof is higher than the determined low load so as to transport air from the refrigerant system determined that the load thereof is higher than the determined low load toward an air-conditioned zone of the refrigerant system determined to be under the low load; and the one or more circulators and the indoor units are communicatively connected to the controller, and the one or more circulators and the indoor units are each independently controllable by the controller.

2. The air-conditioning apparatus of claim 1, wherein the controller determines magnitude of a load on a basis of an operating frequency and a stroke volume of a compressor of each refrigerant system.

3. The air-conditioning apparatus of claim 1, wherein the controller calculates a product of the operating frequency and the stroke volume of the compressor of each refrigerant system, and determines that the load is higher as a product of the operating frequency and the stroke volume of the compressor of each refrigerant system is larger.

4. The air-conditioning apparatus of claim 1, wherein if the controller determines that improvement of operating efficiency is expected, the controller operates one of the circulators disposed at a position at which the circulator is capable of drawing blown air blown from a corresponding one of the indoor units of the refrigerant system determined that the load thereof is higher than the determined low load, and causes the circulator to draw the blown air and to blow the air toward an air-conditioned zone of the refrigerant system determined to be under the low load.

5. The air-conditioning apparatus of claim 1 further comprising:

three refrigerant systems comprising the plurality of refrigerant systems, wherein, if the controller determines that improvement of operating efficiency is expected on a basis of a determination result obtained by the load determination device, the controller performs the system-selective operation in which one of the refrigerant systems determined to be under the low load is stopped and the other refrigerant systems determined to be under a high load or an intermediate load that the load thereof is higher than the determined low load is selectively performed, operates one of the circulators so as to transport air from one of the refrigerant systems determined to be under the high load or the intermediate load toward an air-conditioned zone of the refrigerant system determined to be under the low load.

6. The air-conditioning apparatus of claim 5 wherein, if the controller determines that improvement of operating efficiency is expected on the basis of the determination result obtained by the load determination device, the controller operates one of the circulators disposed at a position at which the circulator is capable of drawing blown air blown from one of the refrigerant systems determined to be under the high load or the intermediate load, and causes the circulator to draw the blown air and to blow the air toward an air-conditioned zone of the refrigerant system determined to be under the low load.

7. The air-conditioning apparatus of claim 5, wherein each of the three refrigerant systems is disposed so as to air-condition corresponding three air-conditioned zones formed by dividing the room into three in one direction, and if the refrigerant system determined to be under the low load is one of two refrigerant systems that air-condition the air-conditioned zones at both ends, the controller determines whether improvement of operating efficiency is expected by selectively operating one of the refrigerant systems that air-conditions one of the air-conditioned zones at a center on the basis of the determination result obtained by the load determination device, and if the controller determines that improvement of operating efficiency is expected, the controller performs the system-selective operation in which the refrigerant system determined to be under the low load is stopped and the operation of the refrigerant system that air-conditions the air-conditioned zone at the center is selectively performed.

8. The air-conditioning apparatus of claim 7, wherein the controller determines that improvement of operating efficiency is expected if a sum of a product of an operating frequency and a stroke volume of a compressor of the refrigerant system determined to be under the low load and a product of an operating frequency and a stroke volume of a compressor of the refrigerant system that air-conditions the air-conditioned zone at the center is smaller than or equal to a product of a compressor frequency and a stroke volume of the compressor of the refrigerant system that air-conditions the air-conditioned zone at the center, the compressor frequency being a frequency at which overall adiabatic efficiency of the compressor is maximum.

9. The air-conditioning apparatus of claim 5, wherein each of the three refrigerant systems is disposed so as to air-condition corresponding three air-conditioned zones formed by dividing the room into three in one direction, and if the refrigerant system determined to be under the low load is one of the refrigerant systems that air-conditions one of the air-conditioned zones at a center, the controller determines whether improvement of operating efficiency is expected by selectively operating one of the refrigerant systems determined to be under the high load, and if the controller determines that improvement of operating efficiency is expected, the controller performs the system-selective operation in which the refrigerant system determined to be under the low load is stopped and the operation of the refrigerant system determined to be under the high load is selectively performed.

10. The air-conditioning apparatus of claim 9, wherein if the controller determines that improvement of operating efficiency is not expected by selectively operating one of the refrigerant systems determined to be under the high load, the controller determines whether improvement of operating efficiency is expected by selectively operating one of the refrigerant systems determined to be under the intermediate load, and if the controller determines that improvement of operating efficiency is expected, the controller performs the system-selective operation in which the refrigerant system determined to be under the low load is stopped and the operation of the refrigerant system determined to be under the intermediate load is selectively performed.

11. The air-conditioning apparatus of claim 10, wherein the controller determines that improvement of operating efficiency is expected by selectively operating the refrigerant system determined to be under the high load if a first condition is satisfied, the first condition being a condition that a sum of a product of an operating frequency and a stroke volume of a compressor of the refrigerant system determined to be under the low load and a product of an operating frequency and a stroke volume of a compressor of the refrigerant system determined to be under the high load is smaller than or equal to a product of a compressor frequency and a stroke volume of the compressor of the refrigerant system determined to be under the high load, the compressor frequency being a frequency at which overall adiabatic efficiency of the compressor is maximum.

12. The air-conditioning apparatus of claim 11, wherein, if the first condition is not satisfied, the controller determines whether a second condition is satisfied, the second condition being a condition that a sum of a product of an operating frequency and a stroke volume of a compressor of the refrigerant system determined to be under the low load and a product of an operating frequency and a stroke volume of a compressor of the refrigerant system determined to be under the intermediate load is smaller than or equal to a product of a compressor frequency and a stroke volume of the compressor of the refrigerant system determined to be under the intermediate load, the compressor frequency being a frequency at which overall adiabatic efficiency of the compressor is maximum, and if the second condition is satisfied, the controller determines that improvement of operating efficiency is expected by selectively operating the refrigerant system under the intermediate load.

13. The air-conditioning apparatus of claim 1, further comprising a temperature sensor disposed in the living area of the air-conditioned zone of each refrigerant system, and, during a cooling operation, the controller determines that a load is higher as a detection value of the temperature sensor is higher and, during a heating operation, the controller determines that a load is higher as a detection value of the temperature sensor is lower.

14. The air-conditioning apparatus of claim 1, further comprising a radiation temperature sensor that measures temperatures of a floor and a wall of a living space of the air-conditioned zone of each refrigerant system, and, during the cooling operation, the controller determines that a load is higher as a detection value of the radiation temperature sensor is higher and, during the heating operation, the controller determines that a load is higher as a detection value of the radiation temperature sensor is lower.

15. The air-conditioning apparatus of claim 1, wherein the controller determines a number of people present in the living space of the air-conditioned zone of each refrigerant system based on the detection results from the load detection device, and, during the cooling operation, the controller determines that a load is higher as a number of people present in the living space of the air-conditioned zone is larger, and, during the heating operation, the controller determines that a load is higher as a number of people present in the living space of the air-conditioned zone is smaller.

16. The air-conditioning apparatus of claim 1, wherein the controller detects an operating state of office automation apparatuses in the air-conditioned zone of each refrigerant system, and, during the cooling operation, the controller determines that a load is higher as a number of office automation apparatuses in operation is larger, and, during the heating operation, the controller determines that a load is higher as a number of office automation apparatuses in operation is smaller.

17. The air-conditioning apparatus of claim 1, wherein if the controller determines that it is sunny during the cooling operation, the controller determines that a load is higher if the air-conditioned zone is nearer to a window, and, if the controller determines that it is sunny during the heating operation, the controller determines that a load is higher as the air-conditioned zone is farther from the window.

18. The air-conditioning apparatus of claim 1, wherein the plurality of refrigerant systems have respective air-conditioned zones in the room, the indoor units are linearly arranged in each of the air-conditioned zones, the circulators are linearly arranged in each of the air-conditioned zones, the circulators in one of the air-conditioned zones blows air toward an other of the air-conditioned zones, and the controller, during the system-selective operation, operates the circulators arranged in the air-conditioned zone of the refrigerant system determined that the load thereof is higher than the determined low load.

* * * * *